United States Patent [19]

Lahr

[11] Patent Number: 4,792,249

[45] Date of Patent: Dec. 20, 1988

[54] VACUUM PAPER TRANSPORT SYSTEM FOR PRINTER

[75] Inventor: Roy J. Lahr, Los Angeles, Calif.

[73] Assignee: Creative Associates Limited Partnership, Los Angeles, Calif.

[21] Appl. No.: 883,849

[22] Filed: Jul. 10, 1986

Related U.S. Application Data

[63] Continuation of Ser. No. 778,293, Sep. 20, 1985, abandoned, which is a continuation of Ser. No. 570,738, Jan. 16, 1984, abandoned.

[51] Int. Cl.[4] ..... B41J 13/00

[52] U.S. Cl. ..... 400/578; 400/579; 400/624; 400/627; 400/656; 271/197; 271/276

[58] Field of Search ..... 400/551, 578, 579, 624, 400/625, 627, 656, 662; 101/232, 382 MV; 51/235; 162/363, 366, 367, 368, 369, 370, 371, 372, 373; 198/689.1; 226/95; 242/182, 185; 248/362, 363; 269/21; 271/194, 196, 197, 276; 355/38 E, 145 H, 73, 76, 91, 93; 414/72, 73

[56] References Cited

U.S. PATENT DOCUMENTS

| | | | |
|---|---|---|---|
| 716,846 | 12/1902 | Lueckenbach | 162/366 |
| 2,753,181 | 7/1956 | Anander | 248/363 |
| 2,814,233 | 11/1957 | Anander | 248/363 |
| 2,969,869 | 1/1961 | Klinger | 271/197 |
| 3,182,998 | 5/1965 | Peterson | 198/689 |
| 3,311,238 | 3/1967 | Huff | 198/689 |
| 3,356,199 | 12/1967 | Robinson | 400/656 |
| 3,359,648 | 12/1967 | Overly et al. | 271/197 |
| 3,477,558 | 11/1969 | Fleischauer | 271/197 |
| 3,536,003 | 10/1980 | Oderman | 101/415.1 |
| 3,618,738 | 11/1971 | Boyatt et al. | 400/549 |
| 3,678,216 | 7/1972 | Rousso et al. | 179/100 |
| 3,827,548 | 8/1974 | Matsuo | 198/689 |
| 4,005,653 | 2/1977 | Arkell | 101/382 |
| 4,017,793 | 4/1977 | Haines | 269/21 |
| 4,056,057 | 11/1977 | Smith | 101/382 MV |
| 4,101,018 | 7/1978 | Sokolowski | 400/582 |
| 4,237,466 | 12/1980 | Scranton | 101/382 MV |
| 4,252,307 | 2/1981 | Korte | 271/19 S |
| 4,275,968 | 6/1981 | Irwin | 355/14 SH |
| 4,294,539 | 10/1981 | Spehrley, Jr. | 226/95 |
| 4,319,743 | 3/1982 | Rood | 271/184 |
| 4,326,636 | 4/1982 | Kawakami | 209/534 |
| 4,326,656 | 4/1982 | Gregory et al. | 226/59 |
| 4,349,269 | 9/1982 | Okada | 355/14 SH |
| 4,364,683 | 12/1982 | Shakib et al. | 400/637.6 |
| 4,371,157 | 2/1988 | Hunt et al. | 271/7 |
| 4,373,848 | 2/1983 | Bishop | 198/689 |
| 4,438,917 | 3/1984 | Janssen et al. | 400/579 |
| 4,457,662 | 7/1984 | Ireland et al. | 198/689 |
| 4,463,361 | 7/1984 | Koumura et al. | 400/662 |
| 4,469,026 | 9/1984 | Irwin | 101/232 |

FOREIGN PATENT DOCUMENTS

| | | | |
|---|---|---|---|
| 136377 | 10/1981 | Japan | 400/662 |

OTHER PUBLICATIONS

G. C. Greuling et al; "Jam Clearance and Plenum Position Sensor System"; *IBM Technical Disclosure Bulletin;* vol. 23, No. 3, pp. 945–946; Aug. 1980.

*Primary Examiner*—David A. Wiecking
*Attorney, Agent, or Firm*—Kenyon & Kenyon

[57] ABSTRACT

A controlled paper transport arrangement utilizes a flexible belt which attracts the paper to its surface by the application of a reduced air pressure on the other side. In a preferred embodiment, the belt operates in a continuous loop and in combination with a vacuum feed roller, the belt and the vacuum feed roller being arranged on respective sides of a print strike bar. The presence of the paper against the flexible belt causes trip valves to change state such that the full force of the air pressure differential between the ambient air and the reduced air pressure, on either side of the flexible belt, is applied only in the vicinity of the paper to be printed. In some embodiments, the vacuum feed roller is sectored so that the reduced air pressure is applied only in the region which communicates with the paper to be printed. The flexible belt and its associated assembly is tiltable about its vacuum supply inlet for achieving compact storage and for delivering printed sheets to a storage bin. In operation, the flexible belt and the vacuum roller can be driven in reverse to allow reprinting.

40 Claims, 15 Drawing Sheets

20
22C
22B
22A
50
28
41
21
10
40
37
42
34
33
32
38

50
20
21
28
27
41
37
40
42
34
33
32
38

60
21
22A
22B
22C
31
59
61
40
27
43
71
72
34
116
71
37
51
73
66
66
67
67
67
23A
62
32
33
70
74
70
66
23B

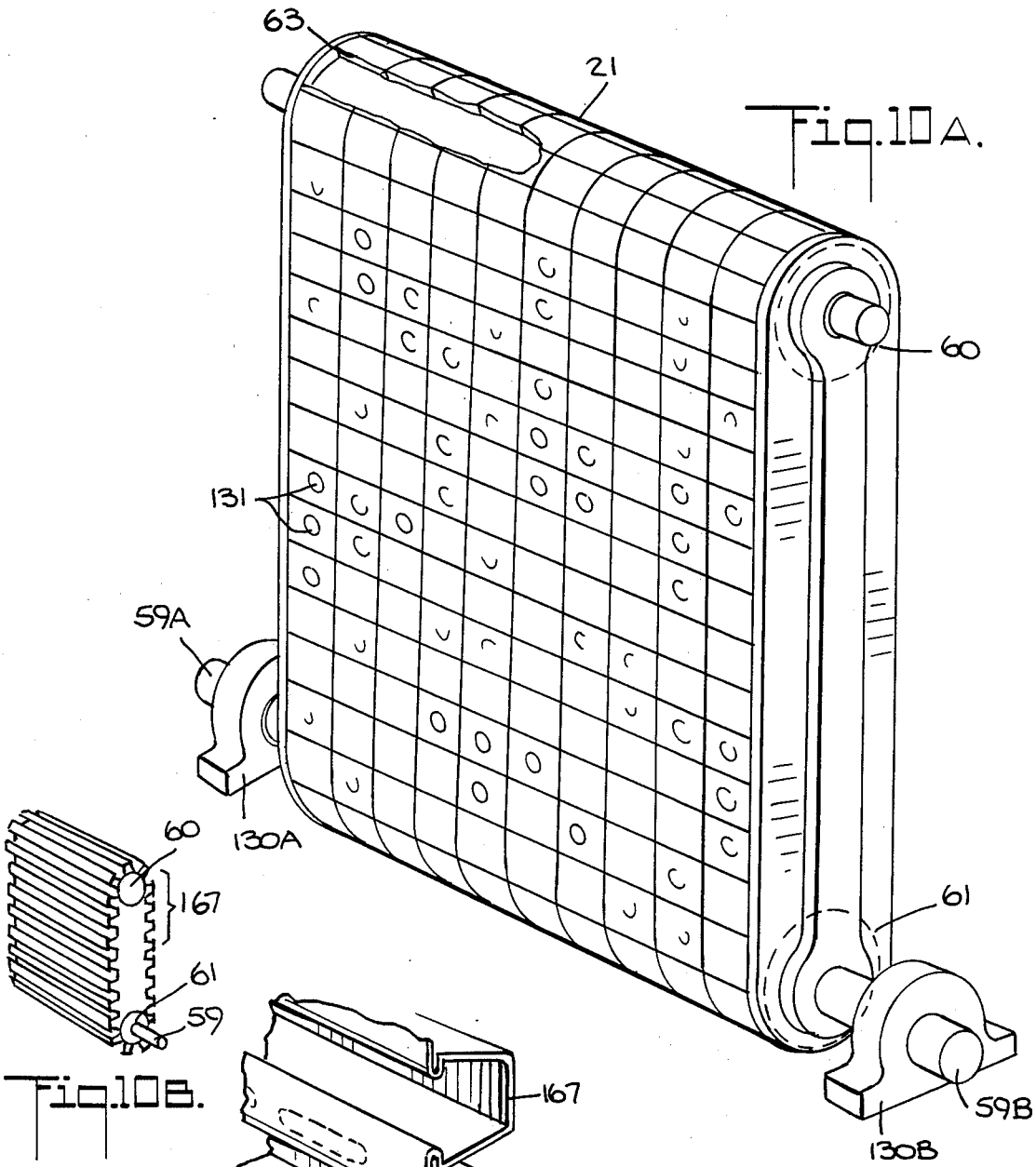
Fig. 10A.
Fig. 10B.
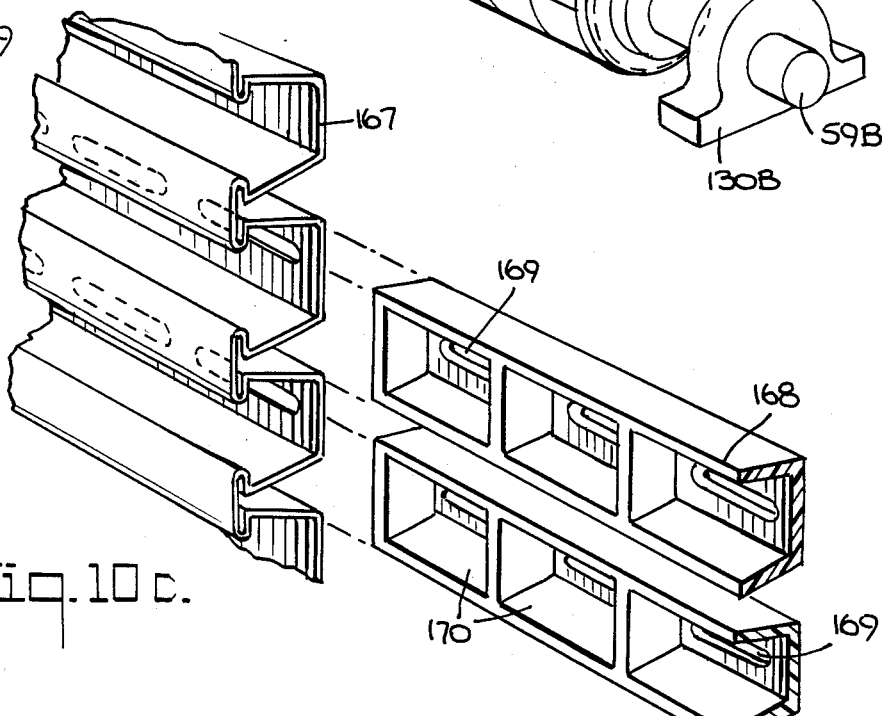
Fig. 10C.

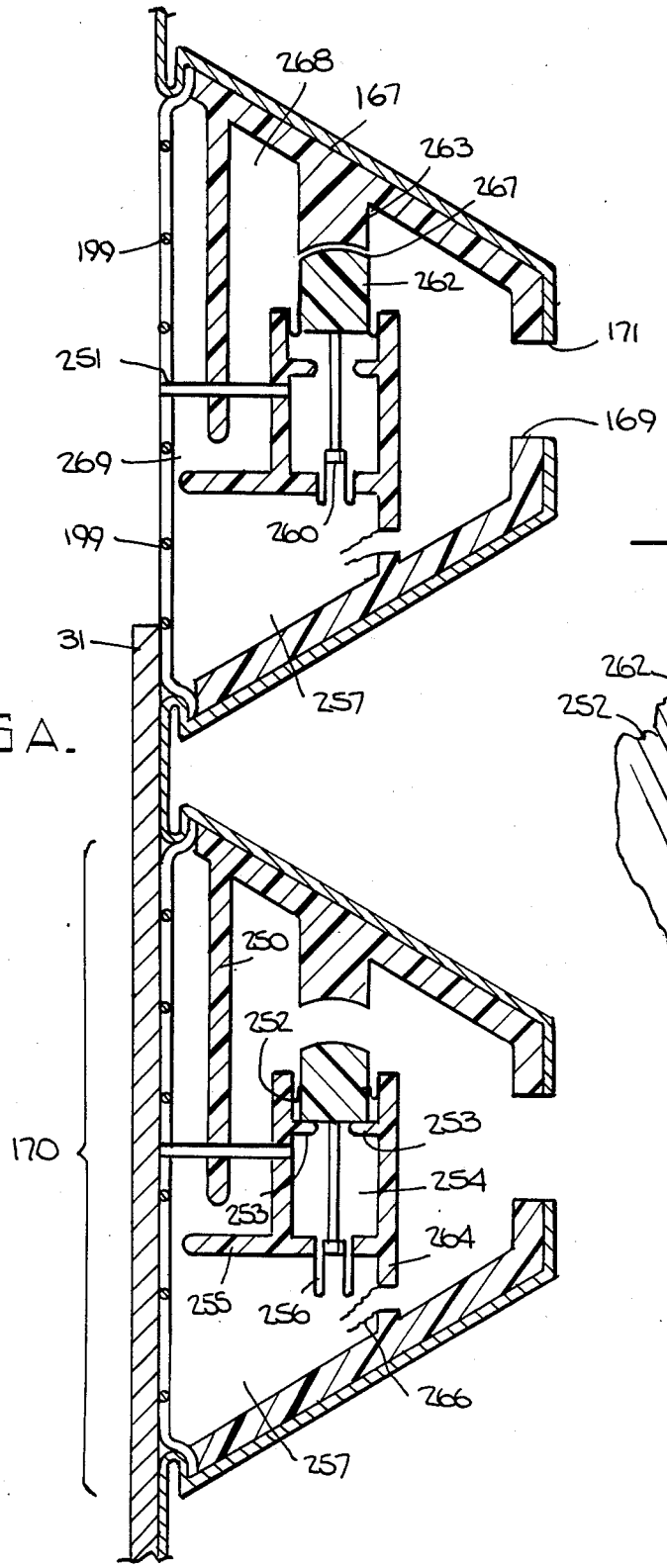
Fig. 15A.
Fig. 15B.
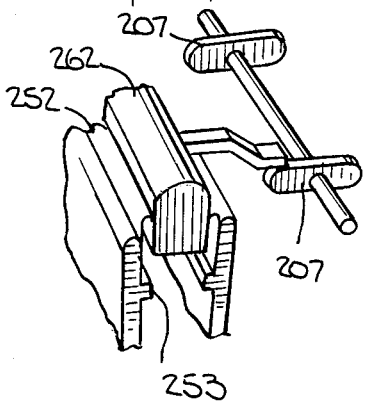

VACUUM PAPER TRANSPORT SYSTEM FOR PRINTER

This application is a continuation of Ser. No. 778,293, filed 9/20/85, now abandoned, which is a continuation of Ser. No. 570,738, filed 1/16/84, now abandoned.

RELATIONSHIP TO OTHER APPLICATIONS

This disclosure is related to, and incorporates by reference, the following applications filed concurrently herewith:

- Rotary Printer With Off-Carriage Motor Drive, Ser. No. 570,737, now abandoned and refiled on 11/27/85 as Ser. No. 802,620, now abandoned.
- Shift System for Multi-Row Print Element Ser. No. 570,739, now abandoned.
- System for Using Multiple Print Heads in Single Printer, Ser. No. 570,732, now abandoned.
- Changer Arrangement for Information-Bearing Elements, Ser. No. 570,745, now abandoned.
- Printer Supplies Monitoring System, Ser. No. 570,744, now abandoned and refiled on 11/1/85 as Ser. No. 794,951, now abandoned.
- Ribbon Indicia System, Ser. No. 570,734, now abandoned and refiled on 11/8/85 as Ser. No. 797,180, now abandoned and refiled on 2/20/87 as Ser. No. 018,802.
- Vacuum Buffered Ribbon Transport System, Ser. No. 570,913, now abandoned, refiled as Ser. No. 794,961 on 11/4/85 now abandoned and refiled as Ser. No. 004,748 on 1/8/87, issued as U.S. Pat. No. 4,747,715 on 5/31/88.
- High Capacity Ribbon Supply Arrangement, Ser. No. 570,746, now abandoned, refiled on 11/12/85 as Ser. No. 797,748, issued on 4/14/87 as U.S. Pat. No. 4,657,418.
- Splittable Keyboard for Word Processing, Typing and Other Information Input Systems, Ser. No. 570,747, now U.S. Pat. No. 4,661,005, issued 4/28/87.
- Rotary Print Element, Components Thereof, and Drive Coupling Apparatus therefor, Ser. No. 570,733, now abandoned and refiled on 9/18/85 as Ser. No. 777,564, now abandoned and refiled on 7/9/86 as Ser. No. 884,873.

BACKGROUND OF THE INVENTION

Most known printing arrangements, which may be either typewriters or printers of the type which are provided at output computer terminals, utilize a cylindrical platen in combination with a plurality of smaller rollers to control the position of the paper which is to be printed. Usually, the cylindrical platen is formed of a fairly hard, yet resillient, material which may be rubber or plastic. The smaller rollers are generally formed of a softer, more resilient rubber or plastic material. The paper to be printed is arranged so that one surface of the paper contacts the cylindrical platen, which may have a diameter of approximately 2 inches, and the surface of the paper which is to be printed is in contact with the smaller rollers. Generally, the smaller rollers are arranged circumferentially about the cylindrical platen roller so as to cause the paper to be printed to be in contact with the roller platen above and below where the printing is to be performed.

It is a problem with this arrangement that the smaller rollers are required to roll over areas of the paper which have been printed. This permits the smaller rollers to pickup ink from the printed material and spread or smear the ink over the paper. In addition, the known roller arrangement tends to lose its grip on the paper. This results from the fact that the platen roller and the smaller rollers are generally made of a material which will react with the air and its pollution components to form a fairly smooth, oxidized surface thereon. Such an oxidized surface has a substantially reduced coefficient of friction which will permit shifting of the paper. As the paper is shifted slightly, a mechanical stress in the form of a shear is imparted to the paper causing it to distort. Thus, in addition to removing ink from the printed paper and smearing that ink, mechanical paper transport systems further suffer from a reduced ability to grip the paper and prevent its shifting as the material from which the rollers are formed deteriorates, and problems associated with stressing and distorting the paper. Since at least some of these distortions are produced after printing, realignment on the printer of the print on the distorted paper is practically impossible in situations where it is desired to print over the paper once again to include additional material. A particular problem arises when printing near the bottom of a page where few rollers contact the paper, thereby producing misalignment, especially when printing on card stock.

In other known arrangements for holding paper to be printed in appropriate position and orientation for printing, electrostatic forces are used to attract the paper. Generally, the paper is placed on a substantially flat surface containing buried grids on which is impressed a high voltage. Such a high voltage causes an electrostatic charge to be induced on the paper, the electrostatic charge causing attraction between the paper and the surface. Electrostatic paper holding systems are known to be used in plotters to secure the paper in a fixed position while one or more pens, or a stylus, are moved with respect to the paper to inscribe information thereon.

It is a problem with known electrostatic paper-holding systems that a residual charge may be retained by the paper. Such charges, which may be significant, may cause substantial difficulty in handling the paper after the information has been inscribed thereon and the paper has been removed from the working surface of the machine. For example, such residual charges may cause the sheets of paper to attract one another, thereby rendering stacking of the charged paper sheets difficult, particularly during periods when the ambient humidity is quite low.

It is a further problem with electrostatic paper-holding systems that the high voltages which are required to render the arrangements operable may cause radiation problems in other electronic equipment which is being used in the vicinity of the electrostatic paper-holding system. This and other difficulties with high voltage equipment are recognized by safety inspection and other certifying institutions which are charged with the responsibility of protecting the public from dangerous or unstable equipment. Thus, high voltage electrostatic paper-holding arrangements are subjected to stringent safety tests, which vary from agency to agency in the various countries. For example, in one well known certifying laboratory a voltage of up to 20,000 volts is impressed on the equipment via a hand-held wand. This voltage is applied to determine whether any ill effects are produced in the internal electrode circuitry, and such circuitry must be protected accordingly.

It is a further problem with electrostatic paper-holding arrangements that they are not reliable in holding the paper to the surface during all commonly encountered situations. For example, it is entirely probable that an operator might generate up to 15,000 volts of static electricity by walking on a carpet, particularly on a day of low humidity. The discharge of such a static charge on the electrostatic arrangement can easily unlock the paper, thereby permitting it to shift during printing. It is yet a further problem of such electrostatic systems that the surface upon which the paper is printed must be generally planar. Thus, the use of electrostatic attraction to hold the paper to a cylindrical or flexible paper transport arrangement is not feasible.

A still further arrangement which can be used for holding paper which is desired to be printed utilizes magnetic forces to achieve the desired attraction. In such an arrangement, a permanent or electrically activated magnet arrangement in the platen would attract either paper or other sheet material which is embedded with magnetic materials of opposite magnetic polarity. In addition to substantial initial expense resulting from the magnets required in the hardware, additional expense is incurred by requiring the paper stock to be embedded with magnetic material. Thus, magnetic attraction is unduly expensive.

One further system which is utilized to attract and hold paper to a surface employs a vacuum which is applied to a plurality of apertures through a surface. Although a vacuum arrangement avoids many of the problems discussed hereinabove, a vacuum hold arrangement is subject to other problems. In a vacuum arrangement where a surface having apertures is required to hold paper of various sizes, it is a problem that if the entire surface is apertured to allow freedom of placement of the paper, or accommodation of various sizes of paper, a very powerful source of low pneumatic pressure is required to maintain a sufficient vacuum force under a relatively small piece of paper, while high air volume is drawn through the remaining open apertures. This problem is particularly acute when the paper stock is both small and not very resilient, such as a 3" by 5" index card. It is a further problem with such a system that the inrush of air through the exposed apertures causes objectionable noises which may be unacceptable in a business environment. In addition, the large amount of air which is drawn through the open apertures may be accompanied by lint, dust, or other matter which can have an adverse effect on the operation of the equipment. Such problems are particularly acute when the paper is just beginning to pass a printing zone, and only a small portion of the paper is present on the vacuum platen. At such times, there may not be sufficient vacuum to hold the edge of the paper by the few apertures which engage the paper.

It is, therefore, an object of this invention to provide an improved paper and sheet material transport arrangement which is not subject to the foregoing problems.

It is a further object of this invention to provide a paper transport arrangement which utilizes vacuum to attract and hold the paper.

It is another object of this invention to provide a paper or sheet material transport arrangement which does not require special stock having special materials embedded therein to be operable.

It is still a further object of this invention to provide a vacuum operated paper transport arrangement which does not produce the objectionable wind noise of known systems.

It is still another object of this invention to provide a sheet material transport system which permits accurate alignment and realignment of a sheet to be printed upon whereby second and subsequent print cycles for adding additional text, highlighting, or graphics, will register accurately with previously printed material, notwithstanding that the sheet to be printed may have been removed from and reinstalled on the sheet material transport system.

It is yet a further object of this invention to provide a vacuum operated paper transport arrangement wherein the area over which a holding vacuum is applied is automatically adapted to the size of the sheet material being held i.e., without specific attention by the operator.

SUMMARY OF THE INVENTION

The foregoing and other objects are achieved by this invention which provides a paper transport system of the type wherein paper sheets which are to be printed are received from a supply thereof and transported across a predetermined print zone where printing may occur. Upon being delivered to the vicinity of the paper transport system, a vacuum roller having a plurality of apertures on its surface attracts the paper by providing a reduced air pressure at the apertures. Such a reduced air pressure attracts the paper to the roller so that it is gripped thereby, and the paper is transported across the predetermined print zone in response to the rotation of the roller. On the other side of the print zone from the vacuum roller is provided a flexible vacuum conveyor which is provided with a plurality of apertures on a surface thereof for providing a reduced air pressure. The reduced air pressure so produced attracts the paper to be printed such that the paper is now gripped on either side of the print zone.

In an impact printing embodiment of the invention, a printing support is provided in the print zone for supporting the paper during the printing operation. The printing support is preferably formed of a firm material, such as a soft metal, and is preferably configured to have an elongated shape which is arranged generally transverse to the direction of motion of the paper across the print zone. This arrangement is therefore particularly adapted for printer arrangements of the type which utilize a print carriage which moves generally horizontally during the printing of a line of text. In a preferred embodiment, the printing support is provided with apertures immediately above and below a central print zone, in embodiments where print carriage motion is horizontal. The print support has a somewhat hollow interior which communicates with a vacuum supply. Such a vacuum is supplied to the apertures in the vicinity of the print zone for securing the paper.

In a further embodiment, the vacuum roller and the printing support are in vacuum communication by means of a seal. In such an arrangement, a vacuum supply is connected to the vacuum roller which, by means of the seal, transfers vacuum to the interior of the print support. Thus, notwithstanding that the vacuum roller rotates, a predeterminable number of apertures on the surface of the vacuum roller are always within the portion of the surface area thereof bounded by the seal such that a fairly constant vacuum is supplied constantly to the print support.

In a preferred embodiment, the vacuum roller is provided with sectoring means therewithin which control the axial region of the surface thereof over which the vacuum is applied. Preferably such a region is adaptable to correspond with the width of the paper to be printed. Such a limitation on the region where vacuum is applied prevents the vacuum from being applied where the paper will not be present to restrict air flow. Such a conversation of vacuum reduces the required capacity of the vacuum supply system, the consumption of energy, and the operating noise. In such an embodiment, the vacuum roller is sectored to produce a plurality of annular vacuum chambers. A core tube is provided with a plurality of annular sectoring walls arranged therearound and coaxially, and the cylindrical outer wall of the vacuum roller is arranged around the sectoring walls. Thus, each vacuum sector is defined to be intermediate of consecutive sectoring walls, and between the outer surface of the core tube and the inner surface of the outer cylindrical wall. The core tube is provided with perforations so that each of the vacuum sectors can communicate with the internal region of the core tube. Vacuum is supplied to the arrangement by a pair of flexible hoses which are sealably and slidably engaged within the core tube, each such hose entering through a respective end of the core tube. Thus, vacuum is applied only to those sectors which are arranged axially intermediate of the ends of the flexible hoses. In a correspondingly analogous manner, the interior of the print support is also sectored such that vacuum which is conducted thereto from the vacuum roller will not be distributed throughout the length of the print support. Instead, the distribution of vacuum in the print support will correspond to the distribution of vacuum in the vacuum roller.

In a further embodiment of the invention, the vacuum roller may be constructed of cup-shaped segments which rotate freely about the core tube. As such cup-shaped segments are stacked axially on the core tube, they engage with each other so as to seal each other and thereby form sectors.

In a still further embodiment, it is advantageous to construct the vacuum roller in two coaxial halves which can rotate differentially with respect to each other. Such differential movement permits the paper which is being transported across the print zone to be aligned. Sensor devices, which are preferably of an optical nature, can be provided in the vicinity of the print zone to determine whether the paper to be printed upon is properly aligned. In one highly advantageous embodiment of the invention, the sensor device is installed on a print carriage of the printer which moves laterally across the print zone. Mechanism may be provided for driving the vacuum roller, and the flexible conveyor, in either the forward or reverse direction. The reversibility of this paper control system permits the sheet to be printed to be returned to a prior line or region where either a further printing pass is performed, or graphic material can be inserted. Of course, if it is determined that registration has been lost, as may be the case when the vacuum supply is temporarily discontinued, the reversing flexible platen and vacuum roller can retract the sheet to be printed so that it can be realigned by use of the sensor devices.

The flexible vacuum conveyor which is arranged on the other side of the print support from the vacuum roller is, in one embodiment, provided with a plurality of longitudinal sectors such that the distribution of vacuum over the surface of the flexible conveyor is controlled by limiting the areas within the flexible conveyor where the vacuum is applied. It is preferred that the flexible conveyor be arranged around at least first and second rollers, and it is advantageous if at least one of the rollers is provided with a sectoring arrangement, similar to that described hereinabove with respect to the vacuum roller, for limiting the application of the vacuum to selected ones of the vertical sectors within the flexible platen.

In a particularly advantageous embodiment of the invention, the flexible conveyor is provided with a plurality of vacuum cells distributed thereover. Each of such cells is independently in communication with the interior of the flexible conveyor which is supplied with a low pressure vacuum. However, each such cell is also provided with a trigger arrangement which limits communication between the exterior of the flexible conveyor and the interior of the flexible conveyor, except when a sheet of paper to be printed is present immediately outside of the particular vacuum cell. Thus, a valve mechanism in each cell is in a closed state until it is triggered by the presence of a sheet of paper which will cause the valve mechanism to open thereby exposing the paper to the entire negative pressure of the vacuum within the flexible conveyor, thereby firmly attracting and holding the paper to the surface of the flexible conveyor.

The trigger mechanisms which can be utilized in such valve arrangements to respond to the presence of a sheet of paper or envelope thereover can be either mechanical or pneumatic triggering systems. In a mechanical embodiment of the invention, a vacuum bleed is provided to the cell for weakly attracting the paper to the surface of the flexible conveyor. Such a weak attraction, however, is sufficient to displace a trigger which permits a valve flap to open, thereby applying the interior vacuum to the paper to be printed. Such an arrangement, therefore, can be viewed as operating at a high pneumatic impedance during the time that the valve flap is closed and only a bleed orifice is provided. However, upon being triggered, the valve flap opens thereby providing low impedance communication between the interior and exterior of the flexible conveyor.

In a pneumatically operated embodiment of the invention, the cell is subdivided into a plurality of subcells which perform different functions. One such subcell is a pilot cell which, when covered by the sheet of paper, reduces the flow of bleed air, thereby enabling a valve mechanism to open. In some embodiments, a reference chamber is provided in which is maintained essentially atmospheric air pressure. As the vacuum at a pilot subcell end of the reference cell is increased as a result of the presence of paper thereover, the difference in pressure between the reference cell and the pilot cell causes a piston to move, thereby opening a valve mechanism which allows the entire force of the vacuum to be applied to gripping the paper. In such embodiments where each cell is provided with a mechanism for controlling the application of the vacuum, there need not be provided within the flexible conveyor the vertical sectoring described hereinabove. Once the valve mechanisms within the individual vacuum cells on the flexible conveyor have been triggered to allow a full communication between the vacuum in the interior of the flexible conveyor and the exterior, any of several arrangements may be provided for resetting the valve assemblies. A first arrangement for resetting the valves utilizes a plurality of toggle bars arranged on a common shaft such that all of the toggle bars are rotated when the common shaft is rotated. The toggle bars are arranged such that they communicate with respectively associated ones of the valve mechanisms, and as the common shaft is rotated, the toggle bars, which operate as cams, cause mechanical resetting of the valves. In other embodiments, the valves may be reset by momentarily applying a positive pressure to the interior of the flexible conveyor. Such a positive pressure causes the air flow within each such vacuum cell to be reversed, thereby closing the valve mechanism. The valve mechanism, in such fully pneumatic embodiments, is provided with latching arrangements, which may be magnetic in nature, for holding the valves in a closed state notwithstanding that the interior of the flexible conveyor is once again provided with vacuum.

In a preferred embodiment of the invention, the flexible conveyor is arranged so as to move forward and downward in an arcuate, pivotal motion. A first end to be achieved by such motion is the releasing of papers which have been printed in an area on the top surface of the printer case, and immediately in front of the flexible conveyor. Upon the completion of such motion such that the flexible conveyor is essentially horizontal over the surface of the printer where the position of the printed papers is desired, release of the paper may be effected by the application of a positive pressure, which positive pressure may simultaneously reset the valve mechanisms as described hereinabove. Advantageously, such paper is released with the printed side down, thereby maintaining the individual sheet in order and affording a measure of privacy. Secondly, the flexible conveyor may be brought forward, along with the storage bins which hold the supply of paper, so that the overall printer can be stored in a compact, attractive manner. In one embodiment, the flexible conveyor is pivotally supported by an arrangement whereby such forward and downward arcuate motion produces pivotal motion about two centers of pivot. Preferably, a pivot locking arrangement is provided such that once the flexible conveyor has pivoted forward about one of the pivot centers, further pivotal motion about that pivot center is locked and prevented, thereby permitting pivotal motion only about the second pivot center. In this manner, the flexible conveyor can be nested within a housing in an attractive manner which also protects the flexible conveyor from damage.

BRIEF DESCRIPTION OF THE DRAWINGS

Comprehension of the invention is facilitated by reading the following detailed description in conjunction with the annexed drawings, in which:

FIGS. 10A, 10B, and 10C are isometric representations showing the construction of an embodiment of a flexible conveyor having individual vacuum cells;

FIG. 15 is a cross-sectional representation of a section of a flexible conveyor showing a second embodiment of a pneumatically operated valve arrangement for a vacuum cell.

DETAILED DESCRIPTION

Figure 1:
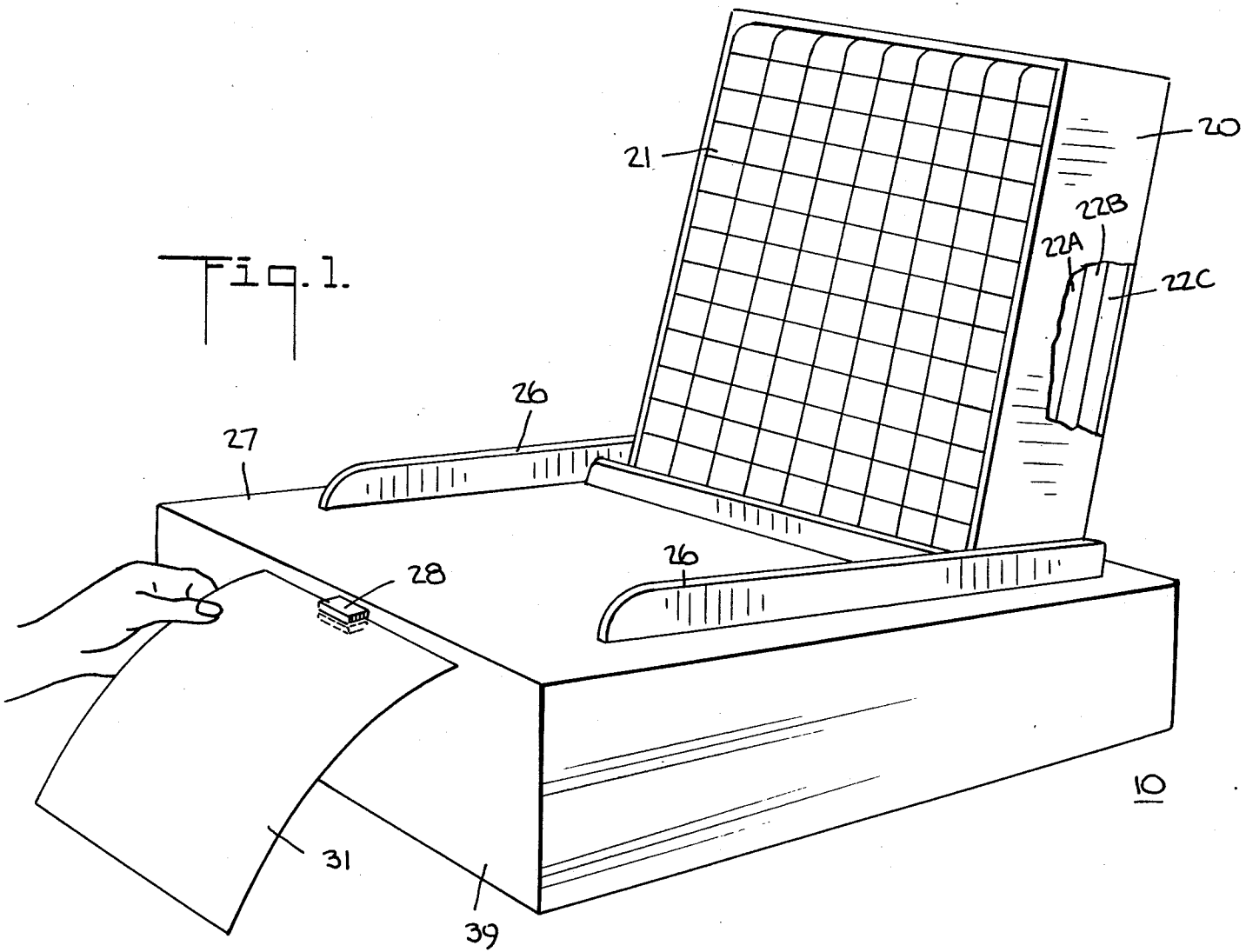
FIG. 1 is an isometric view of the exterior of a printer arrangement constructed in accordance with the invention showing the flexible conveyor in an upward position.

FIG. 1 shows a serial printer which is generally designated 10 and has a tiltable housing 20 containing a vacuum platen 21 at the front and three sheet bins 22A, 22B, and 22C at the rear. Printer 10 is provided with an upper surface which bears two paper rails 26. Vacuum conveyor 21 can be pivoted forward from tiltable housing 20 so as to be substantially parallel with the uppermost surface of printer case 27. From this position, vacuum conveyor 21 discharges a finished printed page previously held thereto onto the space between paper rails 26. This space on printer case 27 and between paper rails 26 thus forms a storage receptacle for finished printed copy, popularly known as an "out basket."

At the front of printer case 27 is provided a paper gage 28 which may operate as a commercially available digital micrometer. When a sheet of paper 31, or an envelope, which is intended for storage in sheet bins 22 is inserted into paper gage jaws 28, the thickness of paper 31 is determined. Each of sheet bins 22A, 22B, and 22C may be provided with a paper stack caliper, not shown in this drawing, which determines the thickness of the total stack of paper. The information pertaining to the thickness of the paper and the total thickness of the stack enables determination of the available paper supply. Additionally, the paper thickness information may be used to adjust correspondingly a vacuum suction force.

Figure 2:
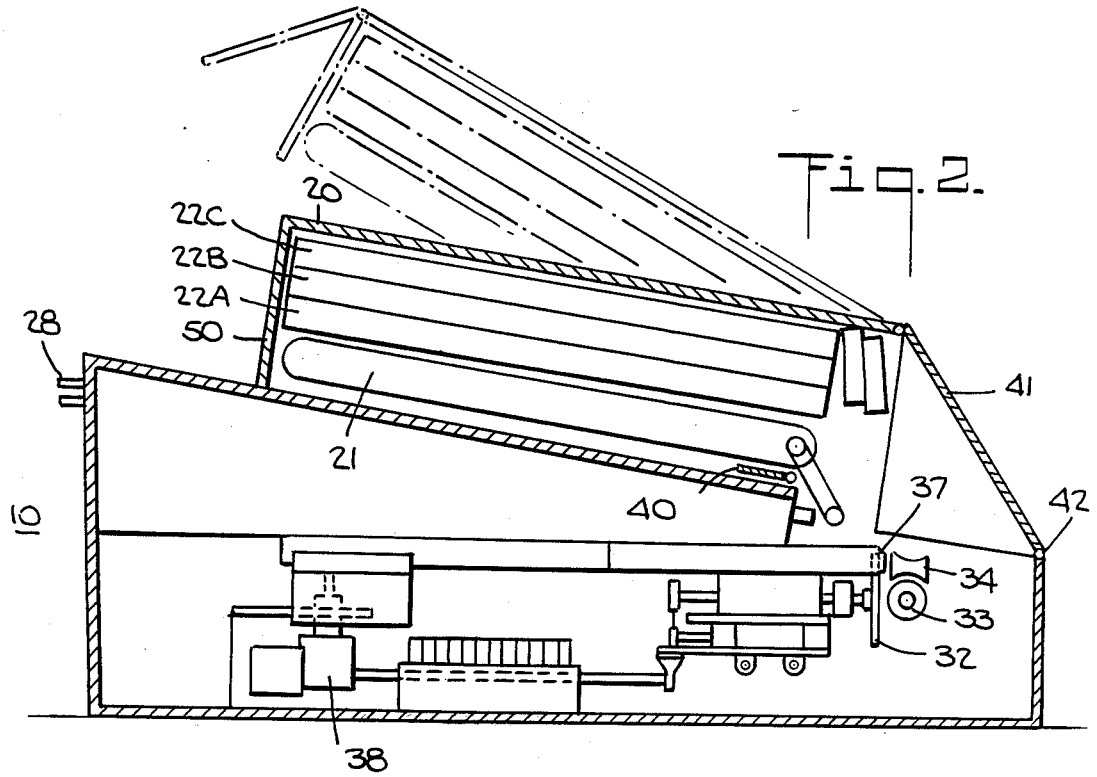
FIG. 2 is a cross-sectional side view of the embodiment of FIG. 1 showing the flexible conveyor in a storage position.

FIG. 2 is a cross-sectional side view from the right side of printer 10, showing vacuum conveyor 21, paper bins 22A, 22B, and 22C, and housing 20 in a forward-pivoted position. As shown, tiltable housing 20 is radially displaced in a forward direction so that the front surface of tiltable housing 20 lies atop the upper face of printer case 27. This position is particularly adapted for storage of the printer. When tiltable housing 20 is in this storage position, a rear paper ledge 40 is tilted to lie flat over the upper surface of printer case 27, so as not to prevent vacuum platen 21 from lying on printer case 27 during storage.

Figure 3:
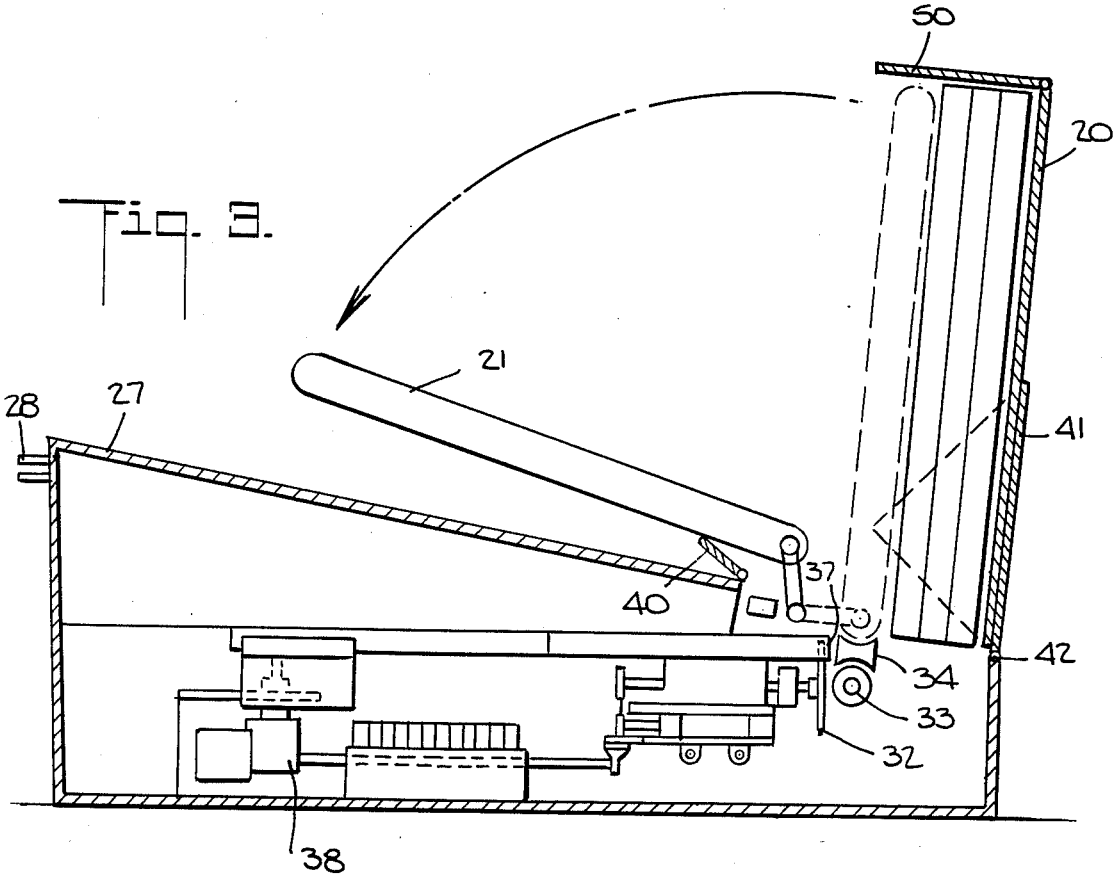
FIG. 3 is a cross-sectional view of the embodiment of FIG. 1 showing the flexible conveyor pivoting forward and downward for depositing printed paper on the surface of the printer arrangement.

In FIG. 3 is shown a print disc drive ensemble 38 which rotates print disc 32 to register desired characters with a print zone, and which moves the print carriage laterally to the correct print column. A supply of film ribbon 37 is provided for the front face of print disc 32. When a hammer (not shown) strikes the print disc on the selected character, that character moves rearward in the print zone, pushing the film ribbon 37 ahead of it until the ribbon strikes the paper stock. If a sheet of paper (not shown in this figure) is placed in behind print disc 32 and film ribbon 37, the impact of the hammer strike will be absorbed by a vacuum print bar 34 which may be formed of a metallic material and provided with a vacuum-operated system (not shown in this figure) for attracting and holding the paper.

In a preferred embodiment of the invention, a vacuum feed roll 33 is provided for engaging paper sheets supplied from bins 22A, 22B, and 22C and driving the paper past vacuum print bar 34 so that it is brought into contact with vacuum platen 21. Vacuum print bar 34, vacuum feed roll 33, and vacuum conveyor 21 are all constructed to have hollow channels or interiors and multiple small apertures through their exterior surfaces communicating with the hollow interiors. Thus, when low pressure vacuum is coupled to the interiors of these elements, the sheets of paper will be attracted to the perforated exterior surface. As an example, low pressure vacuum is supplied to the interior of vacuum print bar 34 so as to hold sheet paper 31 tightly to vacuum print bar 34 during printing. Of course, it is preferred that the vacuum print bar not be provided with apertures in the region of impact.

As an alternative to providing sheets of paper from bins 22A, 22B, and 22C, sheets of paper may be supplied by hand for printing by inserting sheet paper 31 in a manual insert slot 50 atop the upright tiltable housing 50 in FIG. 3. Once inserted in manual insert slot 50, the sheet of paper is affixed to the back of vacuum conveyor 21 by suppling low pressure vacuum to the interior of vacuum conveyor 21. If vacuum conveyor 21 moves in a generally clockwise direction, that is, the rear of vacuum platen 21 moves downward, the sheet of paper will be carried downward until it is affixed by low pressure vacuum to vacuum feed roll 33. When vacuum feed roll 33 rotates in a clockwise direction, sheet paper 31 will move clockwise until brought between ribbon 37 and vacuum print bar 34, ready for printing operations.

Figure 4:
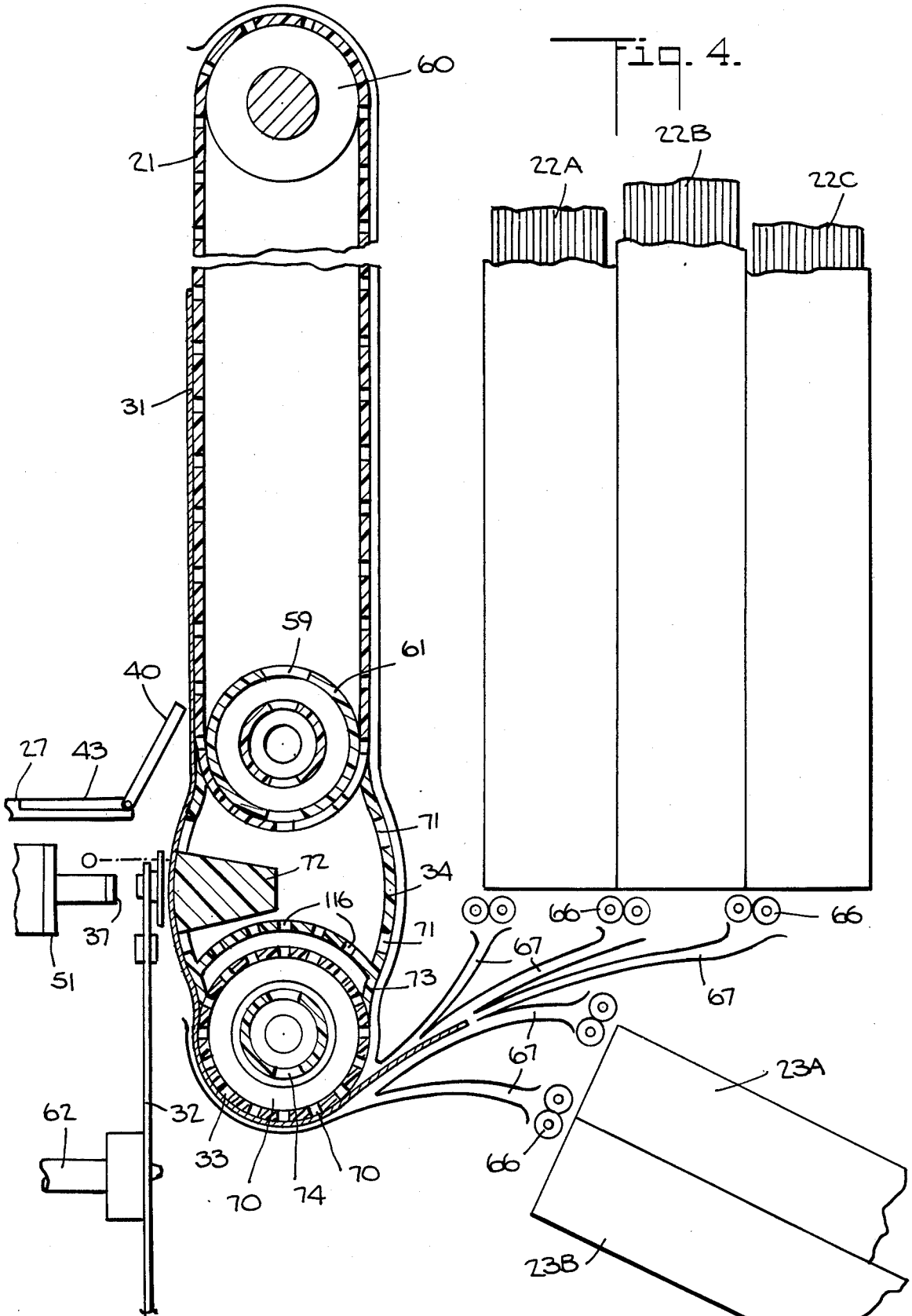
FIG. 4 is a cross-sectional representation of the details of the vacuum roller, the print support, and the flexible conveyor.

FIG. 4 is a cross-sectional view from the right hand side of vacuum conveyor 21, vacuum feed roll 33, vacuum print bar 34, and a feed out system from bins 22A, 22B, and 22C. As shown in FIG. 4, paper stock is stored in three sheet bins 22A, 22B, and 22C, and a supply of envelopes is stored, in this embodiment, in a pair of envelope bins 23A and 23B. When print stock is needed, such as a sheet paper 31, a single-sheet feed roller system (not shown) feeds one sheet paper 31 into a bin feedout roller set 66 from sheet bin 22A, 22B, or 22C. A suitable selector system can be employed to select the proper bin and suitable means can be employed to provide an essentially continuous supply of the paper to the bins. Bin feedout roller set 66 in turn introduces sheet paper 31 to an adjacent bin feedout throat 67. Bin feedout throat 67 then conducts sheet paper 31 to vacuum feed roll 33. Sheet paper 31 passes just over the lower surface of vacuum feed roll 33, so that if low pressure vacuum is introduced to the interior of vacuum feed roll 33, sheet paper 31 will be drawn to the surface of vacuum feed roll 33, as a result of rotation of the vacuum feed roll, sheet paper 31 is driven upwards to an appropriate position in front of vacuum print bar 34. After print disc 32 has been rotated to place a desired character at the print zone by print disc drive shaft 62, and translated to align the print zone at a desired column, a print hammer 51 will impact the selected character, and push it towards film ribbon 37 and sheet paper 31. The character and ribbon are pushed forward together, impacting into sheet paper 31 atop vacuum print bar 34, thereby forming the desired character mark.

After the first line of characters has been printed on sheet paper 31 by print disc 32, vacuum feed roll 33 will increment by a predetermined amount, illustratively 1/6th inch, in embodiments where six lines of printing per inch are required. This action will urge sheet paper 31 upwards after each line printed, until sheet paper 31 passes atop the lower edge of vacuum conveyor 21. Once sheet paper 31 has been incremented upwards by vacuum feed roll 33 across vacuum print bar 34 to where sheet paper 31 is substantially covering approximately the lower half inch of the front side of vacuum conveyor 21, low pressure interior vacuum introduced into vacuum conveyor 21 will cause sheet paper 31 to be drawn fairly strongly thereto.

After such coverage of the lower edge of vacuum conveyors 21 by sheet paper 31, vacuum conveyor 21 is moved in the predetermined increments to raise sheet paper 31 one or more line increments at a time, as desired. Thus, sheet paper 31 travels upward with the front face of vacuum conveyor 21 during the line-by-line printing by print disc 32.

Eventually, when all desired lines of printing on sheet paper 31 have been accomplished, vacuum conveyor 21 pivots radially forward about a center which, in FIG. 4, is arranged near the upper edge of a lower hub 61, thereby causing the top of flexible conveyor 21 to move accurately forward and downward, and rear paper ledge 40 will also pivot forward about its lower edge until it is substantially parallel to printer case 27. Such a pivoting of rear paper ledge 40 allows vacuum conveyor 21 to move downwardly such that if the completed sheet paper 31 document is incremented so that it lies wholly on the front surface of vacuum conveyor 21, and the low pressure vacuum supply to the interior of vacuum conveyor 21 is interrupted, or replaced by low pressure positive air, the completed sheet 31 will fall into the output tray area, printed face down.

Occasionally, it is necessary to perform a second, or even a third, printing pass over sheet paper 31 either before or after removing it from the printer. Such subsequent passes may be required for printing material which was omitted during the previous printings, such as additional text or graphics. If the subsequent printing is performed before removing the sheet paper from the printer, the rear side of vacuum conveyor 21 may be used advantageously to hold sheet paper 31 by reversing the direction of motion of vacuum conveyor 21. Such reversal of the drive direction is performed with sufficient precision that registration with previously printed lines of characters is maintained. Sheet paper 31 is thus passed down over the front of vacuum print bar 34, whereupon the gripping action of a set of print bar vacuum apertures 71 causes sheet paper 31 to slidingly adhere. The sheet paper then travels to vacuum roll 33, where feed roll vacuum apertures grip sheet paper 31 firmly. The counterclockwise motion of vacuum feed roll 33 resulting from its being reverse driven continues, so as to move sheet paper 31 downwardly, around vacuum feed roll 31, and upwards on the back side of the vacuum conveyor. Sheet paper 31 passes over print bar vacuum apertures 71 on the rear side of vacuum print bar 34, after which sheet paper 31 is drawn firmly by vacuum action to the rear surface of vacuum conveyor 21. In one embodiment, sheet paper 31 advances upwards on the reverse side of the vacuum conveyor under incremental drive of vacuum feed roll 33 and vacuum conveyor 21 until sheet paper 31 is in the desired position for the subsequent round of printing by print disc 32. Alternatively, such subsequent printing may be achieved by a separate printing element from print disc 31, such as a dot matrix or ink jet device (not shown in this figure) which is adapted to print against the vacuum print bar.

The continuous gripping of sheet paper 31 by the various vacuum apertures on vacuum conveyor 21 and vacuum feed roll 33 maintains positive motion control and alignment, and with the additional gripping action of the apertures on vacuum print bar 34 holds sheet paper 31 during printing, reducing vibratory and paper web-carried noises to the external evnironment. Additionally, radiated noise from impact printing of print disc 32 on sheet paper 31 is directed towards the sheet paper 31 atop the resilient vacuum conveyor 21 by rear paper ledge 40. In one embodiment, rear paper ledge 40 may be made of tempered glass nominally 3/16 inch thick. Additionally, the rear paper ledge is preferably inclined toward a position corresponding to approximately 40 degrees with respect to the surface of vacuum conveyor 21. A small throat opening which is formed between the upper rear portion of rear paper ledge 40 and the surface of vacuum conveyor 21 is approximately $\frac{1}{8}$th inch in this particular illustrative embodiment, thereby further reducing the release of radiated impact printing noise to the external environment. This $\frac{1}{8}$th inch throat is sufficiently large for passage of envelopes 39 from envelope bins 23A and 23B.

In similar manner to sheet paper 31, envelopes 39 pass from one envelope bins 23A and 23B, through bin feedout roller set 66, and through bin feedout throat 67 whereupon the vacuum generated gripping action and rotary motion of vacuum feed roll 33 brings envelopes 39 onto vacuum print bar 34 for execution of printing action by print disc 32.

In this embodiment, vacuum conveyor 21 communicates with a supply of low pressure vacuum (not shown) via a conveyor vacuum inlet having a tubular shape arranged coaxially with the axis of rotation of lower conveyor hub 59. The elongated shape of vacuum conveyor 21 is maintained by the application of a tensile force between upper conveyor hub 60 and lower conveyor hub 59.

Low pressure vacuum is supplied to vacuum feed roll 33 by a feed roll vacuum inlet 74 having a tubular shape and arranged coaxially with the axis of rotation of vacuum feed roll 33. Vacuum feed roll 33 has almost all of its peripheral surface perforated by a plurality of feed roll vacuum apertures 70. Not only do these feed roll vacuum apertures 70 grip sheet paper 31 when it is situated around vacuum feed roll 33, but, in this specific embodiment, those feed roll vacuum apertures which are on the uppermost 120 degree portion of vacuum feed roll 33 are used to supply low pressure vacuum to stationary vacuum print bar 34 through a vacuum intercoupler 73. Vacuum intercoupler 73 is preferably formed of an elastomeric material which has a low surface friction characteristic so that it may slide freely over the surface of vacuum feed roll 33. As shown, vacuum print bar 34 is in sealing vacuum communication with roller 33 and vacuum conveyor 21. Vacuum intercoupler 73 is firmly affixed to the lower surface of vacuum print bar 34 which is perforated to permit the interior of the hollow vacuum print bar to communicate with the low pressure vacuum supplied via the perforations on the surface of vacuum feed roll 33. Since vacuum print bar 34 does not convey paper in this embodiment, but merely grips it lightly to ensure good print quality on the front side and performs as a paper passage intermediary on the rear side, the vacuum force applied by vacuum print bar 34 does not have to be quite as powerful as the gripping force applied by either vacuum conveyor 21 or vacuum feed roll 33. Thus, the conveyance of vacuum from vacuum feed roll 33 to vacuum print bar 34 through the apertures of both provides the vacuum print bar with sufficient vacuum to prevent motion of the sheet paper or the envelope in response to a possible lateral component of the impact force during printing.

Figure 5:
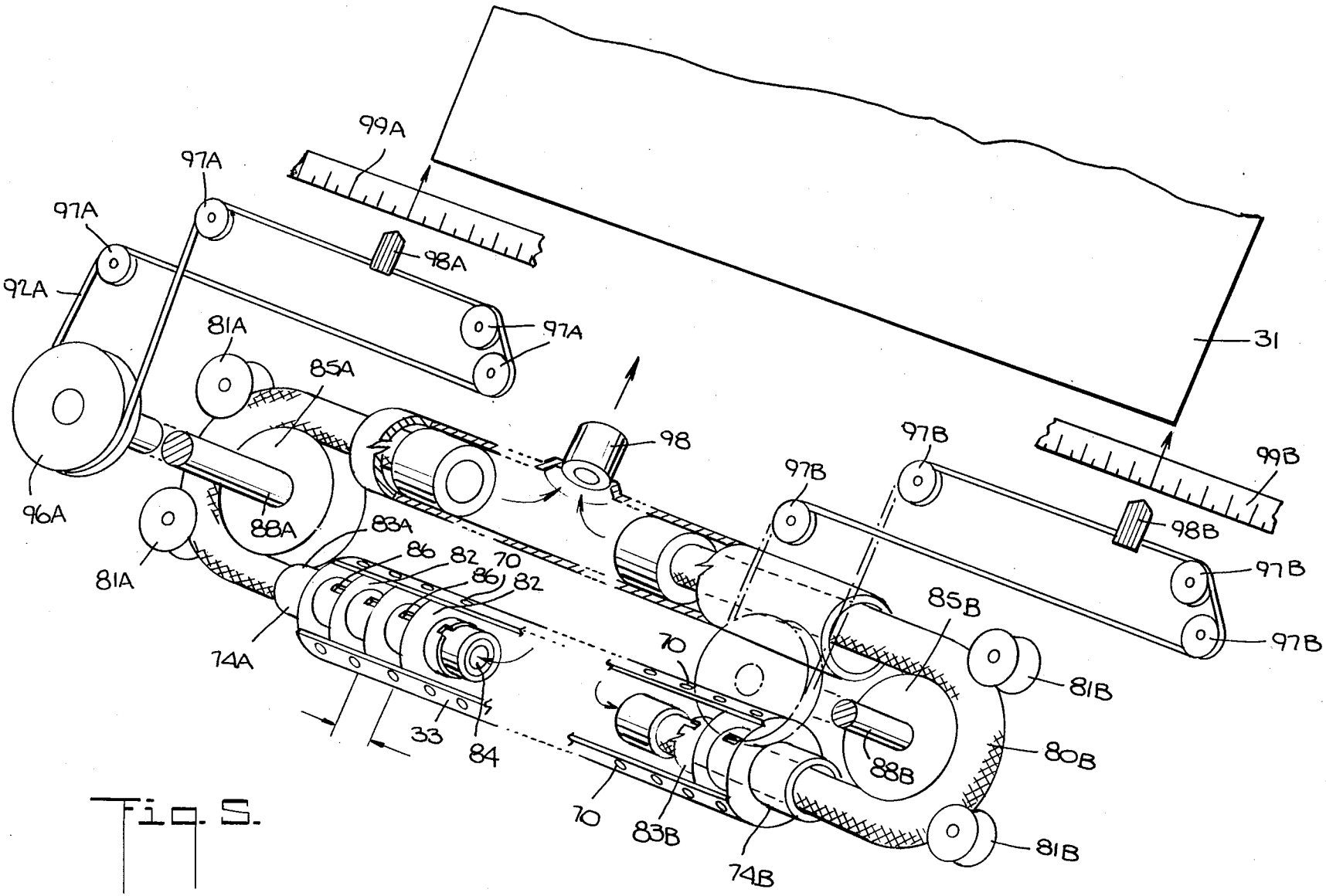
FIG. 5 is an isometric fragmented and exploded view of an arrangement for controlling the axial extent over which the vacuum is applied to the surface of the vacuum roller.

In FIG. 5, vacuum feed roll 33 is shown in a fragmented exploded view. To restrict application of low pressure vacuum to only those feed roll vacuum apertures 70 which lie under sheet paper 31, the inner core of vacuum feed roll 33 is sectioned off by a plurality of feed roll division plates 82. Thus, vacuum feed roll 33 is subdivided into a plurality of feed roll vacuum chambers 79 each having a nominal $\frac{1}{2}$ inch width. Each of feed roll division plates 82 has a central hole, into which is fitted a feed roll core tube 83. Feed roll core tube 83 is heavily perforated by feed roll core tube apertures 86 to allow a flow of low pressure vacuum. However, the bore of feed roll core tube 83A and 83B is sufficiently smooth so that the sliding of a pair of feed roll moving portals 84 is facilitated. Feed roll moving portals 84A and 84B are hollow and are just long enough, illustratively approximately $\frac{5}{8}$ths inch, to span the inner feed roll vacuum chambers 79 formed between consecutive pairs of feed roll division plates 82. Any known indicating arrangement can be utilized to provide an indication of the region in which the vacuum will be applied, which region corresponds to the location of the feed roll moving portals within the feed roll core tubes.

Feed roll moving portals 84 are connected to a pair of vacuum metering hoses 80A and 80B which move freely in feed roll vacuum inlets 74A and 74B, pushing or pulling feed roll moving portals 84A and 84B which are attached to the ends of vacuum metering hoses 80A and 80B within feed roll core tubes 83A and 83B. Thus, when low pressue vacuum is supplied to vacuum metering hoses 80A and 80B, vacuum will be applied only to those feed roll vacuum chambers 79 which are between the two feed roll moving portals 84A and 84B.

Low pressure vacuum is supplied to vacuum metering hoses 80 by a vacuum metering cylinder 89. The ends of vacuum metering hoses 80A and 80B are joined to a pair of metering cylinder moving portals 91A and 91B. In this embodiment, metering cylinder moving portals 91A and 91B are constructed of a low surface friction plastic material so that sliding friction is small, even though the outer diameter of metering cylinder moving portals 91A and 91B is only slightly less than the bore diameter of vacuum metering cylinder 89. Low pressure vacuum is introduced into the midpoint of vacuum metering cylinder 89 through a metering cylinder vacuum inlet 90.

The position of the left feed roll moving portal 84A corresponds to the left edge of the sheet paper 31 or envelope 39 to be printed on. The position of the right feed roll moving portal 84B is positioned separately, and represents the right edge of sheet paper 31 or envelope 39, so as to apply low pressure vacuum to those feed roll vacuum apertures 70 under the width of the overlying printable material. The adjustment of the positions of the left and right feed roll moving portals 84A and 84B so as to correspond with the edges of printable material is achieved by moving vacuum metering hoses 80A and 80B by rotating a pair of metering hose hub rollers 85A and 85B. Metering hose hub rollers 85A and 85B are each provided with a convex groove on its periphery which is configured to match the outer contour and dimension of its associated one of vacuum metering hoses 80A and 80B. The convex grooves are of such material and surface as to grip the outer surfaces of vacuum metering hoses 80A and 80B. Vacuum metering hoses 80A and 80B are held tightly to the surface of metering hose hub rollers 85 by a pair of metering hose pressure roller sets 81A and 81B of diameter smaller than that of metering hose hub rollers 85A and 85B. To change the position of feed roll moving portals 84, the vacuum metering hoses 80 are moved by rotating hose hub rollers 85 through a pair of respectively associated hose hub roller shafts 88A and 88B. The hose hub roller shafts are connected to a pair of portal cable main pulleys 96A and 96B. To rotate portal cable main pulleys 96 so as to position feed roll moving portals 84, a pair of portal moving cables 92A and 92B is attached to portal cable main pulleys 96. In turn, portal moving cables 92 are moved by displacing a pair of portal cable markers 98A and 98B. The movement pattern of portal moving cables 92 and the operating tension is controlled by a pair of portal cable pulley idler sets 97A and 97B.

Portal cable marker 98A is positioned laterally along a paper stock width scale 99A to correspond with the left edge of printable material, as sheet paper 31. Portal cable marker 98B is possitioned laterally along paper stock width scale 99B to correspond with the right edge of the printable material. In accordance with a particularly advantageous embodiment of the invention, an optical sensor, such as that disclosed in my copending application entitled PRINTER SUPPLIES MONITORING SYSTEM, noted hereinabove, may be arranged on each portal cable marker in a system for automatically locating the edges of sheet paper 31. A drive arrangement responsive to such an optical sensor would be coupled to each of hose hub roller shafts 88A and 88B. With a segmented construction of the vacuum feed roll and the vacuum print bar with a metering system, as described herein, the low pressure vacuum flow is conserved and the noise of the flow of air through unobstructed apertures, as in conventional vacuum systems, is substantially reduced.

Figure 6:
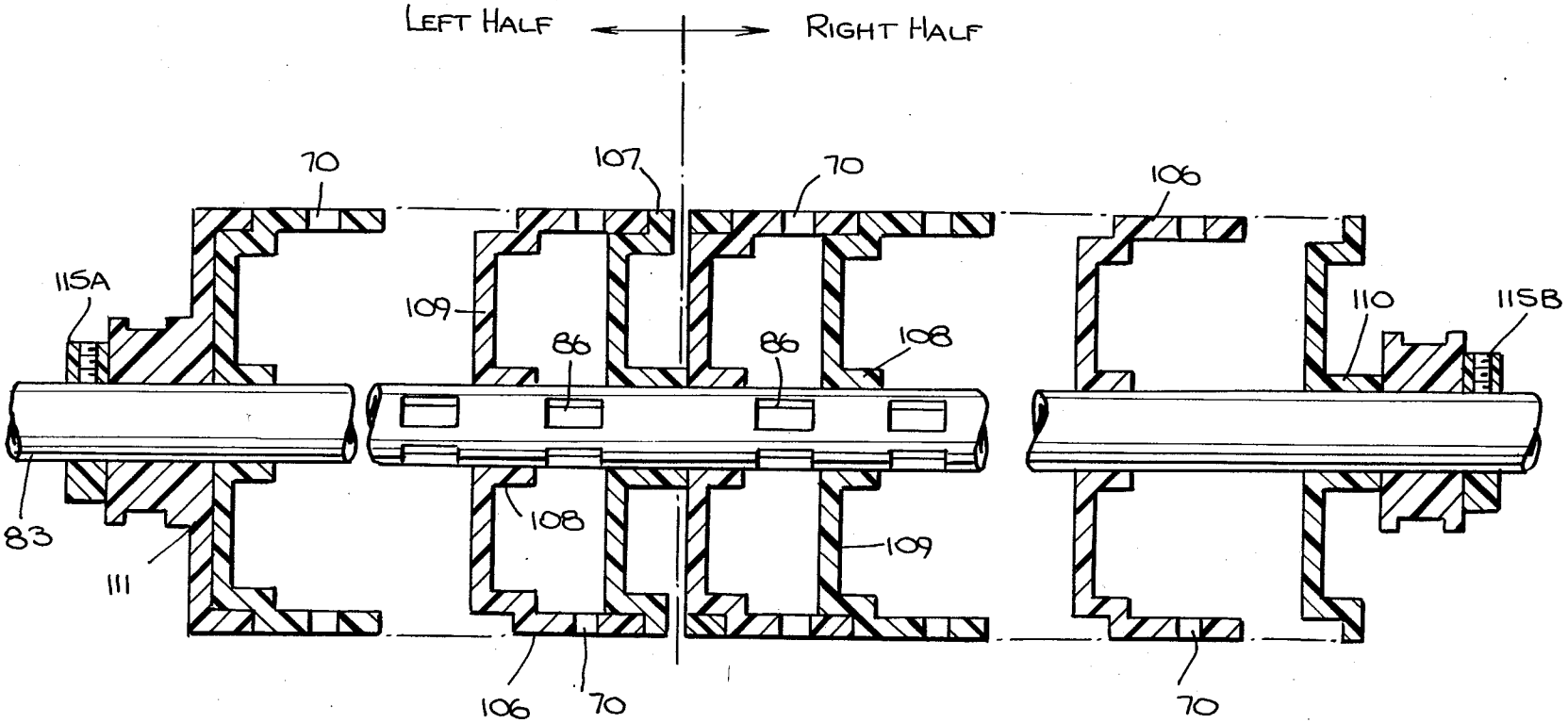
FIG. 6 is a cross-sectional representation of one embodiment of the vacuum roller constructed with stacked segments.

FIG. 6 is a segmented cross-sectional view of a particular illustrative embodiment of vacuum feed roll 33. In this specific embodiment, vacuum feed roll 33 is fabricated from a set of individual feed roll segments 106, each approximately ½ inch in width. Each feed roll segment 106 has a radially extending wall 109 which, when assembled, performs the function of feed roll division plates 82 described hereinabove with respect to FIG. 5. In FIG. 6, set of central feed roll segment flanges 108 and a set of segment shaped outer flanges 112 allow feed roll segments 106 to be abutted together and affixed by solventable adhesive for future repair or inspection. The assembled feed roll segments 106 have an inner diameter just slightly greater than the outer diameter of feed roll core tube 83, and are fabricated of a low friction surface material so as to rotate freely about feed roll core tube 83. In a preferred embodiment, vacuum feed roll 33 is made into two coaxial halves which are each separately rotatable. The two coaxial halves facilitate reorientation of the printable material by a vacuum grip-assisted moment couple produced when one-half of vacuum feed roll 33 is held or moved slightly in a counterclockwise motion while the other half is moved in a clockwise motion with respect thereto.

The construction of the right end of vacuum feed roll 33 is completed by affixing a special rightmost right end pulley plate 110 to the adjacent feed roll segment 106. The pulley emplaced on right end pulley plate 110 facilitates rotation of the right section of vacuum feed roll 33.

The left end of vacuum feed roll 33 is fitted with a pulley for driving the left section of vacuum feed roll 33 by affixing a left end pulley plate 111 to the adjacent feed roll segment 106. Thus, both sections of vacuum roll 33 can be driven independently by the pulleys on left end pulley plate 110 and on right end pulley plate 111, or with the same motion, as the printable material handling situation may require. Differential movement between the two coaxial halves of vacuum feed roll 33 is facilitated by forming the one of feed roll segments 106 which is shown to be just to the right of the centerline split between the coaxial sections of vacuum feed roll 33 so as not to have a circumferential engagement notch in its outer flange 112, in the vicinity of feed roll segment wall 109. Instead, this particular feed roll segment 106 has a full diameter feed roll segment wall 109. In some embodiments, the circumferential engagement notch may be occupied by a segment shaped outer flange 112', as shown. To the left of the midline split, the interior portion of vacuum feed roll 33 has been capped off by affixing an end cap feed roll segment 107.

Although the left and right sections of vacuum feed roll 33 can rotate freely about feed roll core tube 83, the two sections are held from sliding axially by a pair of feed roll end rings 115A and 115B which are arranged on the left end beyond left end pulley plate 111 and on the right end beyond right end pulley plate 110, respectively.

Figure 7:
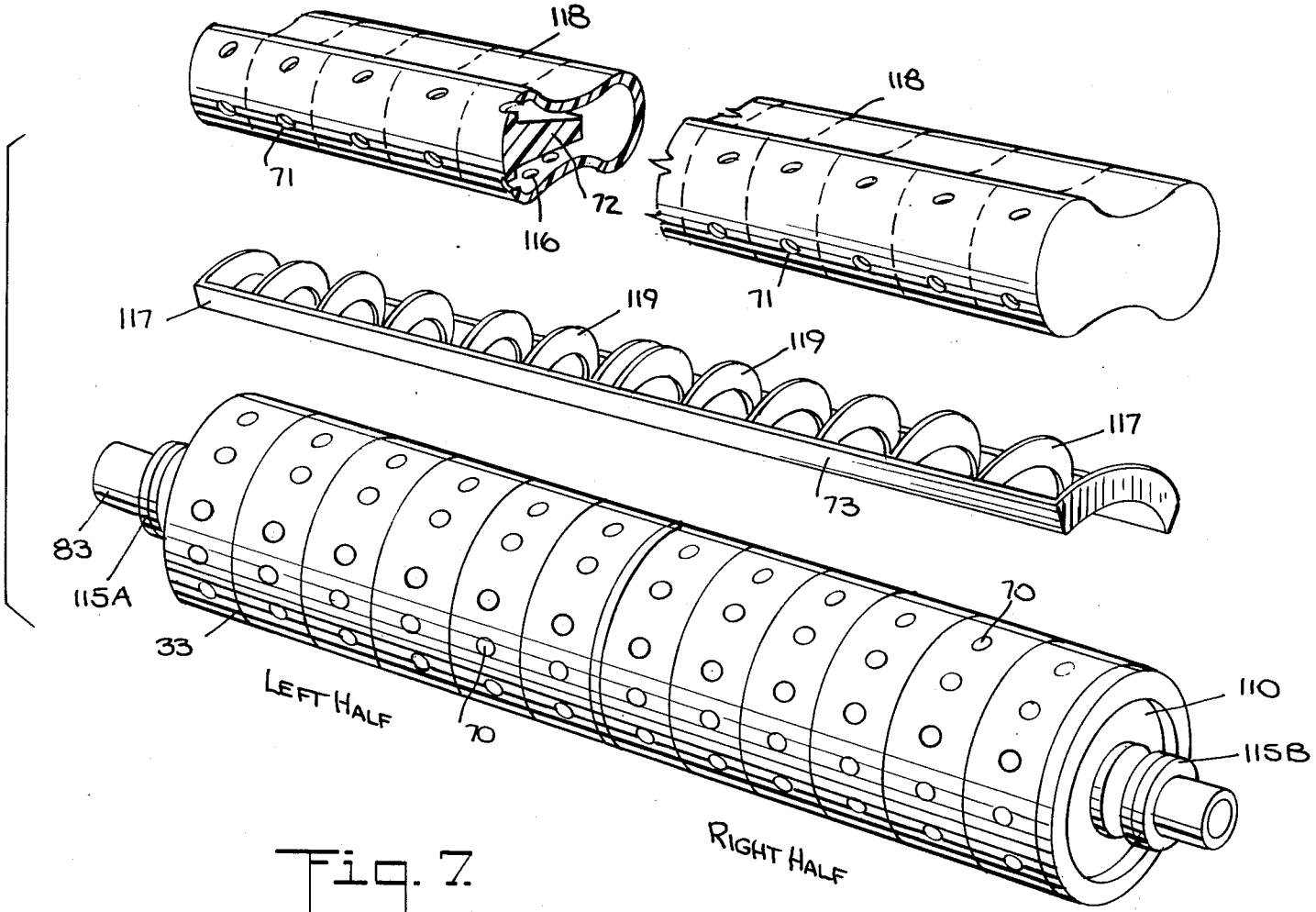
FIG. 7 is an isometric, exploded and fragmented view of a vacuum roller, the print support, and an engagement seal which is arranged therebetween.

FIG. 7 is an exploded cross-sectional and fragmented view of vacuum print bar 34 showing its interior structure. Also shown in this figure are a central print bar impact beam 72, print bar vacuum apertures 71 above and below the front of print bar impact beam 72, print bar vaccum inlet apertures 116 on the bottom side, and with an unperforated top side which is curved to match the contour of vacuum conveyor 21.

Vacuum feed roll 33 has distributed over its surface feed roll vacuum apertues 70; such apertures being selectively supplied with low pressure vacuum across the width of printable materials, as sheet paper 31 or envelopes 39 shown in FIG. 5. As discussed above with respect to FIG. 4, the top 120 degree of feed roll vacuum apertures 70 are used to supply low pressure vacuum to vacuum print bar 34. A set of print bar chambering dividers 118 are used to subdivide the interior of the print bar into a set of print bar chambers 119 which, in this embodiment, are approximately ½ inch in width, so as to match the chambering division of vacuum feed roll 33. These print bar chambers 119 receive low pressure vacuum from vacuum feed roll 33 through vacuum intercoupler 73.

Vacuum intercoupler 73, in addition to the low surface friction elastomeric sides and ends, also has a set of vacuum intercoupler webs 117 which divide the vacuum intercoupler 73 into a series of nominally ½ inch wide intercoupler conductor tubes 119. Since intercoupler tubes 119 have the same nominal width of the chambers in vacuum feed roll 33, the selected width of low pressure vacuum application to vacuum feed roll 33 by the metering apparatus of FIG. 5 is conducted to vacuum print bar 34, thereby supplying low pressure vacuum to vacuum print bar 34 over the same width and positioning as is supplied to vacuum feed roll 33.

Figure 8:
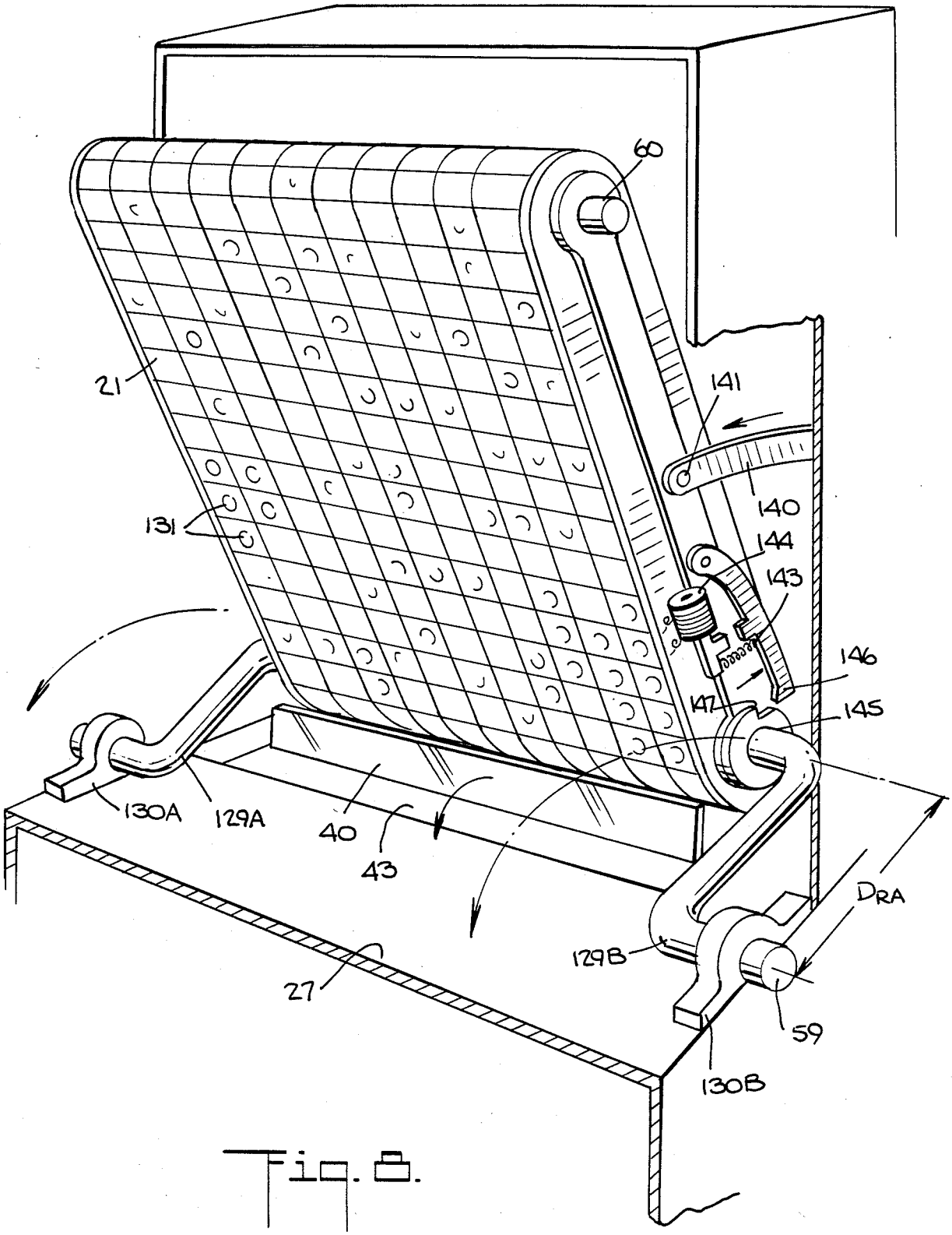
FIG. 8 is an isometric representation of the flexible platen shown in a partially tilted position.

FIG. 8 shows vacuum conveyor 21 which performs two downward swinging motions. The downward, arcuate motion which is more frequently used is that used when discharging printed materials. The motion which is used less frequently is that which occurs when tiltable housing 20 is tilted down, as for storage. The figure shows a conveyor swing operator arm 140 which is mounted in tiltable housing 20 and is fastened at one end thereof to vacuum conveyor 21 by a conveyor operator arm pivot 141 which is arranged on a conveyor side frame 154. When tiltable housing 20 is in the upward, or printing position, swing operator arm 140 can be extended to swing vacuum conveyor 21 downward so as to discharge printed materials when the vacuum conveyor is nearly horizontal. As swing operator arm 140 extends from tiltable housing 20, vacuum conveyor 21 begins to swing outward from just inside tiltable housing 20, with vacuum conveyor 21 moving arcuately outward from the tiltable housing. The initial portion of the arcuate motion is a pivotal motion about the point at which dual-pivot tubes 129A and 129B enter vacuum conveyor 21. A swing latch solenoid 144, which is attached to the frame of vacuum conveyor 21, is energized thereby causing a swing latch 142 to move inwardly against the force applied by a swing latch spring 143. The lower end of swing latch 142 bears an engagement swing latch tooth 146. Swing latch tooth 146 moves against the edge of a latch notch plate 145 which is affixed to the end of dual-pivot tube 129B at the entrance to the frame of vacuum conveyor 21. As vacuum conveyor 21 continues its arcuate downward movement, swing latch tooth 146 moves around the edge of latch notch plate 145 until swing latch tooth 146 engages a latch notch 147 on latch notch plate 145. The engagement of swing latch tooth 146 in latch notch 147 prevents further pivotal motion about dual-pivot tube 129B at the point nearest the frame of vacuum conveyor 21. The continued extension of platen swing operator arm 140 from tiltable housing 20 therefore requires a new center of pivot. Such pivotal motion therefore continues about the ends of dual-pivot tubes 129A and 129B which are mounted in a pair of pivot tube bearings 130A and 130B, respectively. This new radius center causes vacuum conveyor 21 to be raised over the upper edge of rear paper ledge 40 which may be holding many sheets of previously printed material. The generally downward motion of vacuum conveyor 21 continues about the centers of pivot tube bearings 130A and 130B until vacuum conveyor 21 is approximately parallel to the upper side of printer case 27. At this point, vacuum conveyor 21 is situated above printer case 27 by a predetermined distance, which may correspond to the pivot arm distance $D_{pa}$. When discharge of printed material is accomplished, swing operator arm 140 retracts, and vacuum conveyor 21 swings upward about pivot tube bearing 130. This upward swing of vacuum conveyor 21 continues until vacuum conveyor 21 is approximately 30 degrees from tiltable housing 20, at which point swing latch solenoid 144 is de-energized. The continued retraction of swing operator arm 140 into tiltable housing 20 causes vacuum conveyor 21 now to pivot about the end of dual-pivot tube 129 as it enters the frame of vacuum conveyor 21. The retraction of swing operator arm 140 continues until vacuum conveyor 21 is fully housed inside tiltable housing 20. It is a significant advantage of the dual-center pivoting motion described herein that the vacuum conveyor clears the glass rear ledge and the paper deposited on the surface of the printer case. Moreover, the manner in which the vacuum conveyor enters and exits the tiltable housing permits a decorative and protective member to be arranged on the tiltable housing immediately above the vacuum conveyor.

When storing the tiltable housing 20 in the nearly horizontal position against printer case 27, swing operator arm 140 is not extended. Thus, vacuum conveyor 21 remains in its housed location within tiltable housing 20. Tiltable housing 20 is pivoted downward around a radius center at the forward lower edge of tiltable housing 20. When the side edges of tiltable housing 20 contact rear paper ledge 40, the glass rear paper ledge pivots forward and downward about a radius center at its lower edge, as shown in FIG. 4. The arcuate forward and downward motion of rear paper ledge 40 continues until rear paper ledge 40 rests within a paper ledge well 43 which is recessed into the surface of printer case 27. Such motion of rear paper ledge 40 into paper ledge well 43 permits vacuum conveyor 21 to rest against the upper surface of printer case 27 when tiltable housing 20 is in its storage position.

Figure 9A:
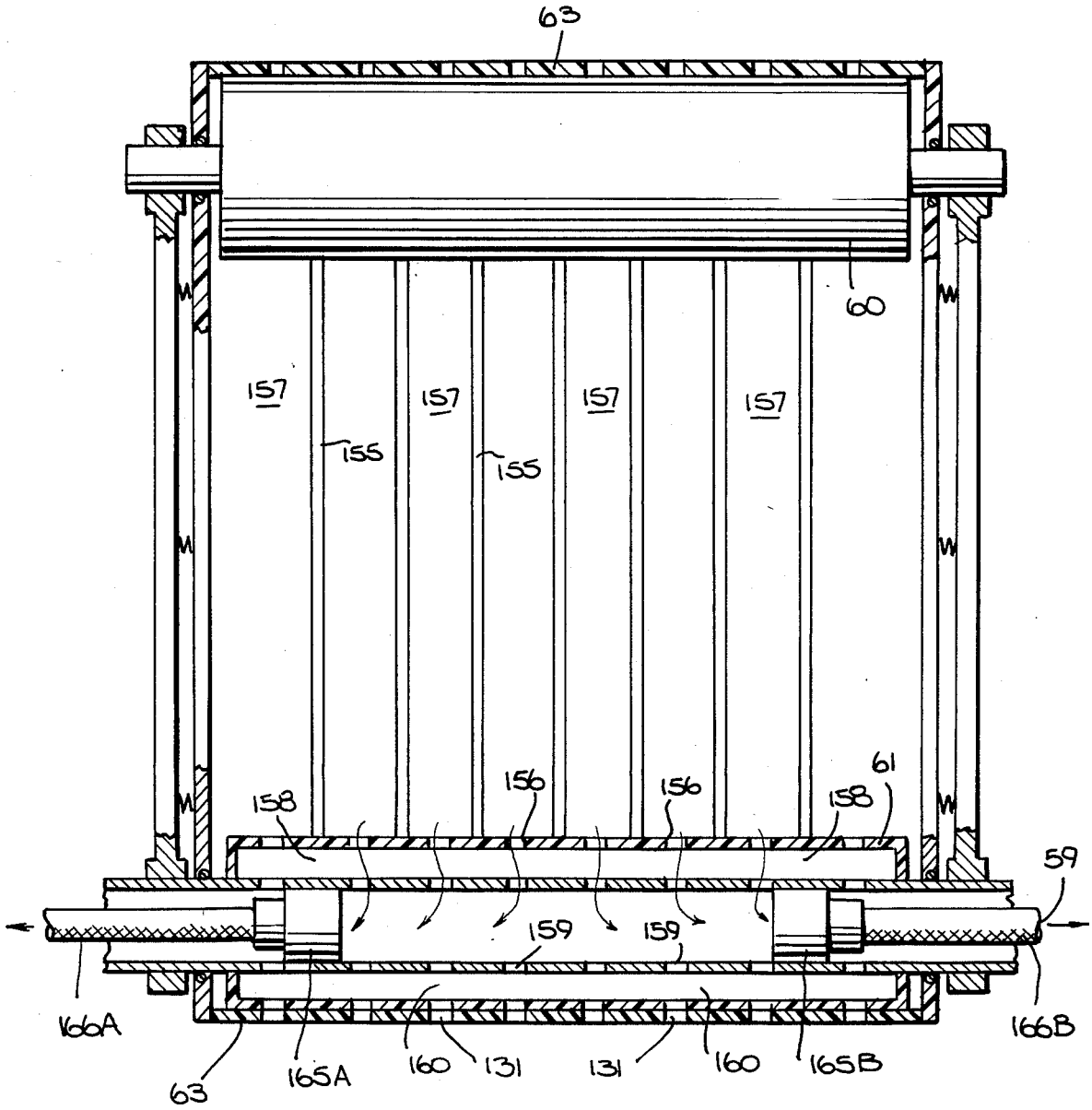
FIGS. 9A and 9B are cross-sectional views showing the internal structure of a vertically sectored embodiment of the flexible conveyor.
Figure 9B:
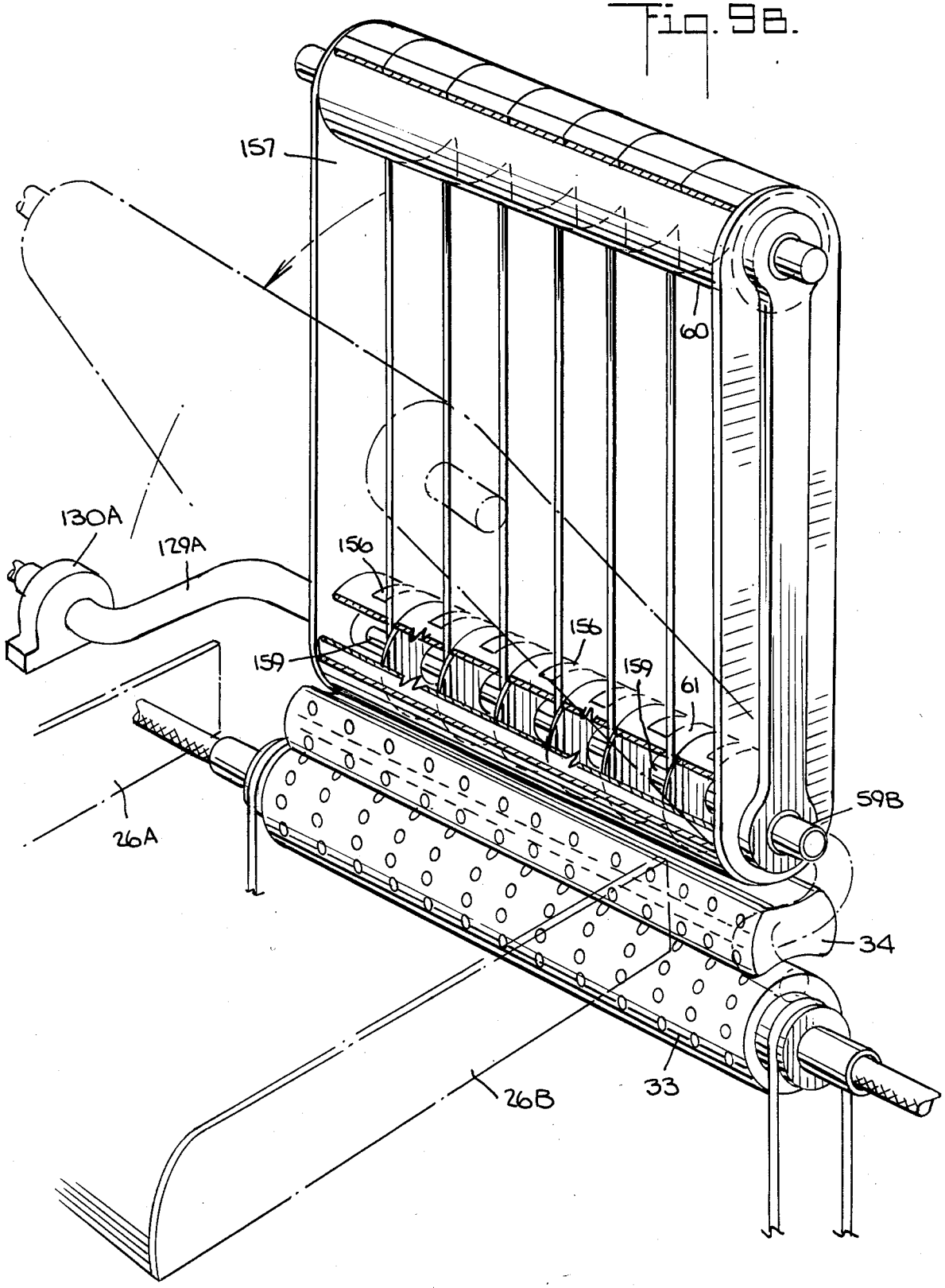

FIG. 9A is a cross-sectional plan view of vacuum conveyor 21, and FIG. 9B shows an isometric representation of FIG. 9A. As shown in these figures, the interior of vacuum conveyor 21 is shown to be divided into a vertical set of vacuum chambers 157 by providing a set of segment plates 155 between the inside front and rear surfaces of a vacuum conveyor belt 63. Upper hub 60 is solid, as there is no need to supply low pressure vacuum to this area of the vacuum conveyor belt 63.

Lower hub 61 is perforated by a set of lower hub apertures 156. Vacuum inlet 59 is perforated by a set of inlet tube apertures 159. The portion of lower hub 61 between perforated vacuum inlet 59 and the inside of perforated lower hub 61 is divided laterally into a set of annular lower hub chambers 160 by a plurality of lower hub segment plates 158. Both lower hub chambers 160 and vacuum chambers 157 in this specific embodiment are constructed to have a nominal ½ inch width, as are feed roll vacuum chambers 79 and the chambers within vacuum print bar 34. Lower hub 61 can also be constructed by assembling cast segments, as is the case with the construction of vacuum feed roll 33 shown in FIG. 6.

In FIGS. 9A and 9B, low pressure vacuum is metered to vacuum conveyor 21 by a pair of moving portals 165A and 165B. These moving portals having an axial width of just over ½ inch in this embodiment, to match the chamber width. Each moving portal is attached to a respective vacuum metering hose 166A and 166B. These two vacuum metering hoses are then supplied with low pressure vacuum as shown in FIG. 5. The adjustment of the width of the vacuum conveyor over which vacuum is provided to match the left and right edges of the printable material, illustratively sheet paper 31 or envelopes 39, is described with respect to vacuum feed roll 33. The difference, of course, is that moving portals 165A and 165B are substituted for feed roll moving portals 84A and 84B of FIG. 5. Since the cylinder metering apparatus shown in FIG. 5 would be identical for both the vacuum conveyor 21 and the vacuum feed roll 33, an alternative would be to utilize a bifurcated end to vacuum metering hoses 80A and 80B and fit moving portal 165A and feed roll moving portal 84A to one bifurcated set, and moving portal 165B and feed roll moving portal 80B to the other bifurcated vacuum metering hose 80B.

FIGS. 10A, 10B, and 10C are isometric representations of vacuum conveyor belt 63 illustrating its internal construction. In FIG. 10A, vacuum conveyor belt 63 is shown to have regularly spaced vacuum apertures 131, with selectable active width. As shown in FIG. 10B, the width selection apparatus of FIG. 5 is presented in alternative form by utilizing a belt base 167 in place of vacuum belt 63, described hereinbefore. As shown in the enlarged, detailed representation of FIG. 10C, belt base 167 is constructed of a semiflexible plastic, such as polypropylene or some other similar material, and its shape permits conformal motion around upper hub 60 and lower hub 61. Belt base 167 is provided with a plurality of elastomeric belt cell strips 168 arranged transverse to the direction of travel. Each belt cell strip 168 is divided laterally into a set of individual strip cells 170. Each individual strip cell 170 is provided with a cell strip aperture 169 in its base, directly atop and of the same size as a group of cell base apertures 171. Although low pressure vacuum lateral metering programs only vertical strips of vacuum apertures 131, the provision of rows of individual strip cells 170 allows each platen vacuum aperture 131 to be separately supplied with low pressure vacuum.

Figure 11B:
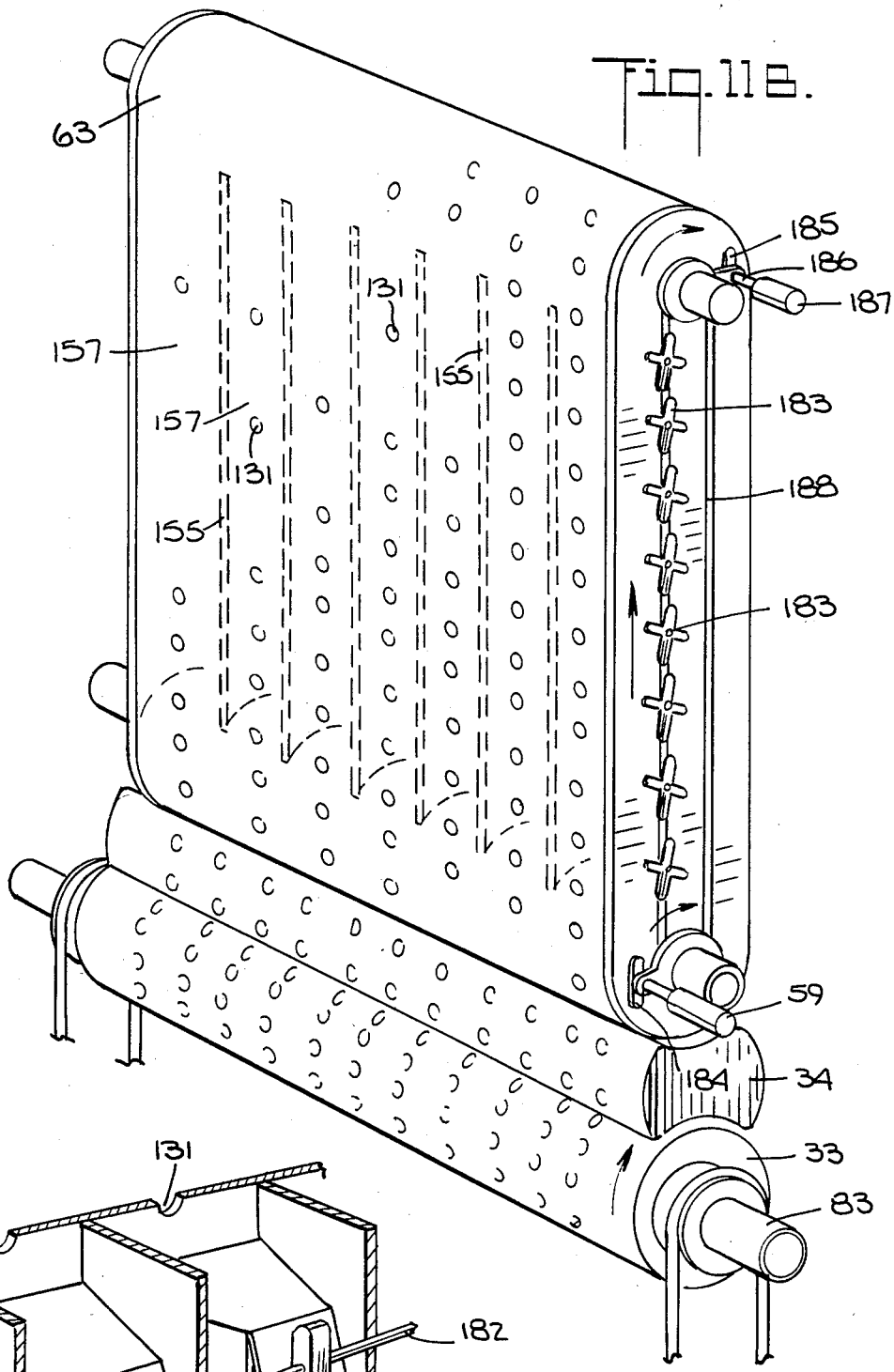
FIGS. 11A and 11B are isometric representations of a mechanical arrangement for opening and closing vacuum valves.
Figure 11A:
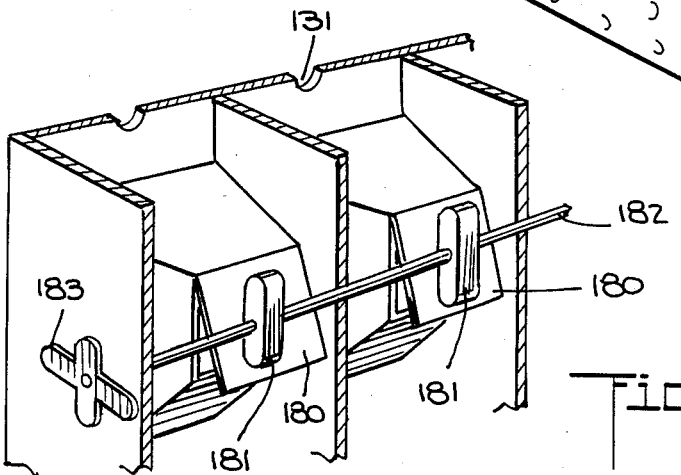

FIGS. 11A and 11B show an arrangement for the mechanical control of a plurality of vacuum control flaps 180 which are shown in FIG. 11A to be at the base of each strip cell 170. Vacuum control flap 180 is fabricated of a material having a self-spring action at the fold in the flap, such as polypropylene, such that vacuum control flap 180 will remain open until forcibly closed. Each row of cells in belt cell strip 168 has a row of flap toggle bars 181, arranged one per individual strip cell 170, and mounted on a toggle bar shaft 182. Toggle bar shaft 182 is rotated by moving a vacuum control cross 183, having one long arm and one short arm. When vacuum control cross 183 is rotated on toggle bar shaft 182, flap toggle bar 181 is rotated above the rear of individual strip cell 170 until one of the two ends of flap toggle bar 181 contacts vacuum control flap 180 and pushes it closed. The vacuum metering system as described with FIG. 9 selects the ones of vertical vacuum chambers 157 which are to be in communication with the low pressure vacuum. All individual strip cells 170 are connected to vacuum chambers 157 through cell strip apertures 169 communicating directly with cell base apertures 171. If a vertical column, vacuum chamber 157, is connected to low pressure vacuum because printed material such as sheet paper 31 will pass over this column, area, vacuum control cross 183 can be rotated to open the vacuum supply to a row of cell strip apertures 169 when the top of sheet paper 31 is just coming over that row. Low pressure vacuum will then be available at all selected exterior vacuum apertures 131, thereby causing sheet paper 31 to adhere firmly to the area which has been supplied with vacuum.

The timing of opening of vacuum control flaps 180 by rotating vacuum control crosses 183 to correspond with the passage of printable material over vacuum apertures 131 is arranged by placing vacuum control crosses 183 in a connected arrangement on the side of vacuum conveyor 21, shown in FIG. 11B. A pair of control cross interposers 184 is affixed on the conveyor side frame 154. When vacuum conveyor belt 63 traverses around conveyor side frame 154, all vacuum control crosses 183 move with vacuum conveyor belt 63 in a control operator sealed track 188.

Figure 12C:
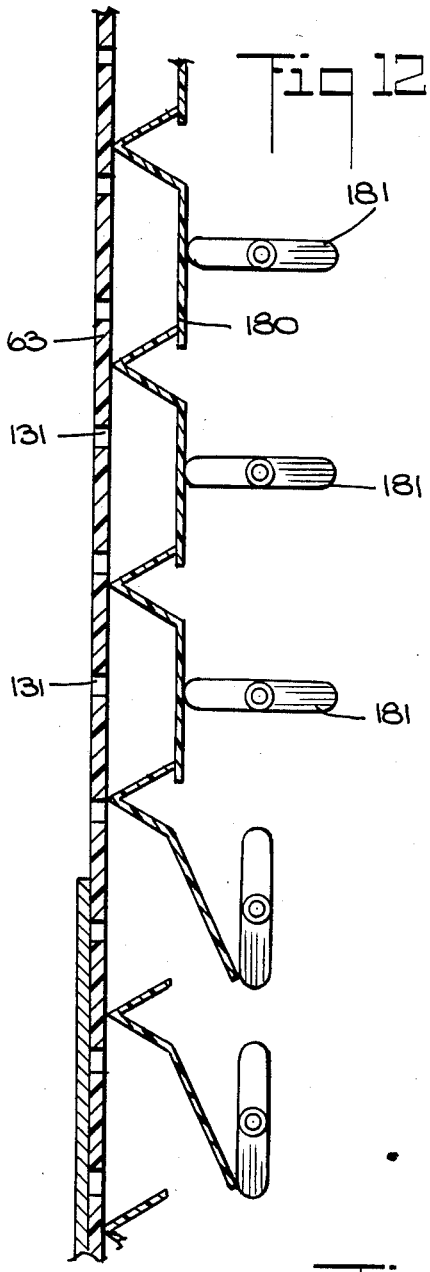
FIGS. 12A, 12B, 12C, 12D, and 12E illustrate selected details of the mechanical switching arrangement of FIGS. 11A and 11B.
Figure 12A:
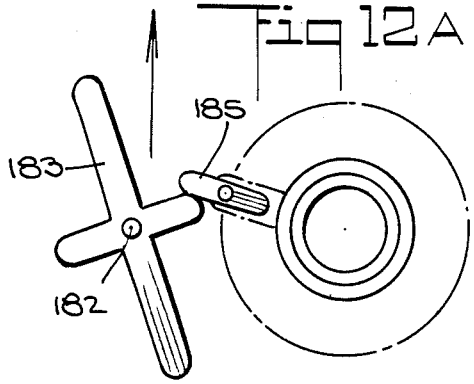
Figure 12B:
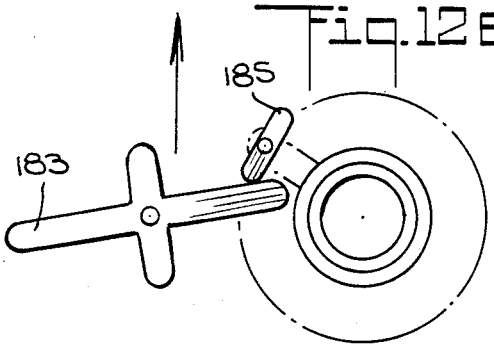
Figure 12E:
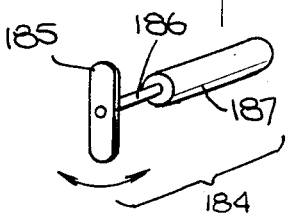

FIGS. 12A–12E show various details of the mechanical vacuum switching arrangement. As shown in FIGS. 11B and 12E, the rotation of a cross interposer operator 187 is transmitted through a cross interposer shaft 186 to rotation of a cross interposer cam bar 185. FIGS. 12A and 12B show the intersection of cross interposer cam bar 185 with vacuum control crosses 183. When stationary control cross interposer 184 has cross interposer operator 187 rotated such that cross interposer cam bar 185 is positioned radially as in FIG. 12A, cross interposer cam bar 185 will engage the shorter arm(s) of the control cross interposer, thereby rotating vacuum control cross 183 by 90 degrees when passing by the interposer station. This 90 degree rotation of toggle bar shaft 182 will cause all flap toggle bars 181 which are mounted on toggle bar shaft 182 to engage and open all associated vacuum control flaps 180, thereby providing low pressure vacuum flow to this row of individual strip cells 170.

Figure 12D:
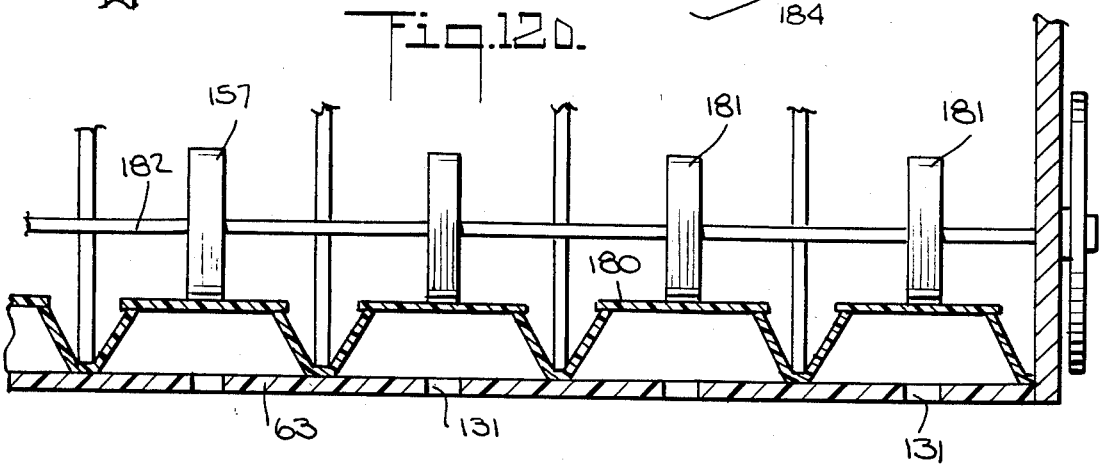

When cross interposer cam bar 185 is positioned in a tangential fashion, as shown in FIG. 12B, cross interposer cam bar 185 will only contact the longer arms of vacuum control cross 183. When any of these longer control arms of vacuum control cross 183 pass cross interposer cam bar 185 so that they will engage cross interposer cam bar 185, i.e., representing a previously selected vacuum control flap 180 open condition, this engagement will reset, or close all vacuum control flaps 180 that pass thereby. By example then, all conditions of vacuum either open or closed can be programmed easily by repositioning only control cross intersector 184 in rotation at a fixed location. All passing vacuum control flaps 180 will then open or close during passage, as desired by setting cross interposer cam bar 185 either radially, so as to open vacuum control flaps 180 on passage by, or tangentially, so as to maintain in a closed state the vacuum control flaps 180 on passage by. FIG. 12C shows the opening and closing of vacuum control flaps 180 in response to the position of flap toggle bars 181. A top view of vacuum control flaps 180 in a closed state is shown in FIG. 12D.

The interposer cam bar 185 will engage both the long and short arm of the cross 183. However, it is only important that it engage the shorter arms in order to open the associated vacuum control flaps 180. As shown in FIG. 11B, when a particular strip reaches the top of flexible conveyor 21, another interposer 185 will close the open valves of a particular strip, i.e., whether interposer 185 is set to the radial or tangential position, as shown in FIGS. 12A and 12B, respectively, cross interposer 183 will be rotated to close the associated valves in a strip of the flexible conveyor by actuation of its longer arm. When the strip again reaches the bottom of the flexible conveyor, a selection can be performed depending upon whether paper is present on the flexible conveyor. If paper is present, interposer cam 185 will be extended so that it will contact the shorter arm (the longer arms are rotated to close the valves of the strip by the upper interposer 185 in FIG. 11B). If no paper is present, then interposer 185 will be in a tangential position, and therefore will not contact any of the shorter arms thereby leaving the valves of a strip in the closed condition as set by the upper interposer 185.

FIGS. 13A–13D are isometric and cross-sectional views of an embodiment of a mechanical trigger arrangement for controlling the application of vacuum automatically in response to the presence of a sheet to be printed.

Figure 13B:
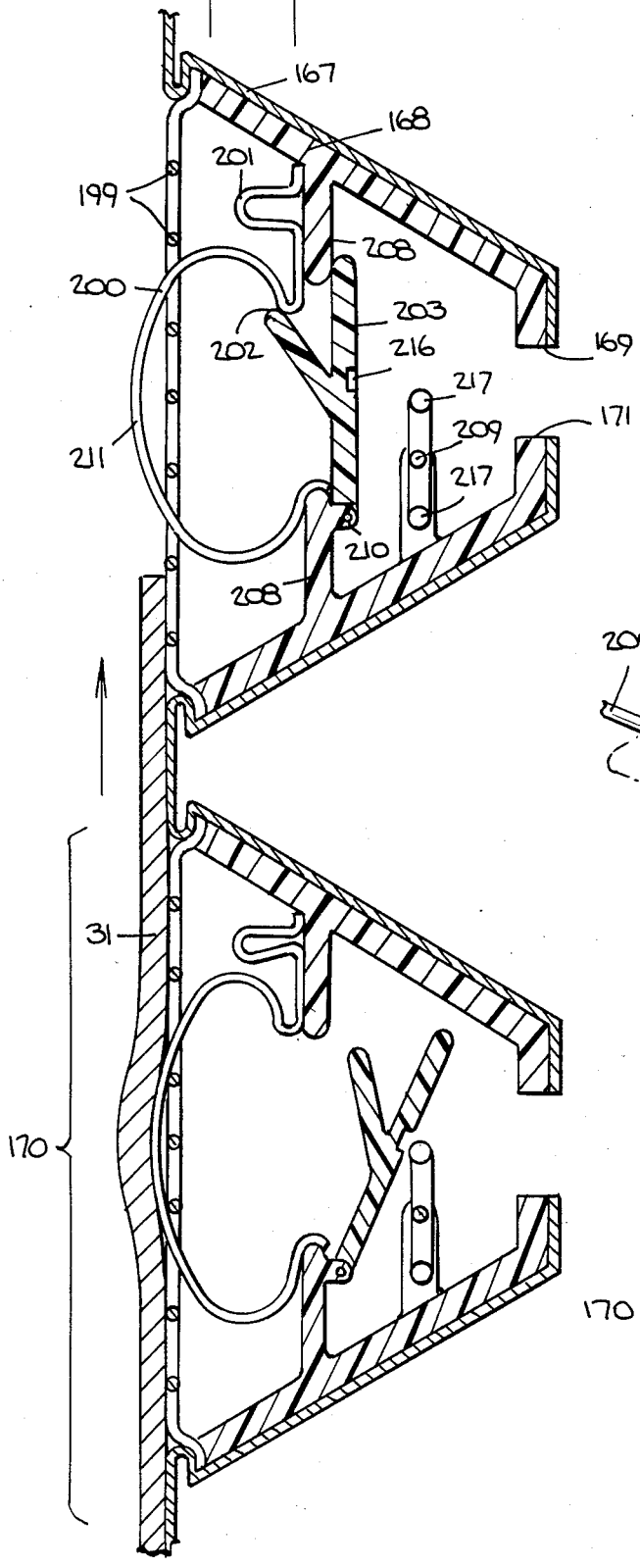
FIGS. 13A, 13B, 13C, and 13D illustrate the details of an embodiment of the flexible conveyor having mechanical triggering for the valves of each vacuum cell.
Figure 13A:
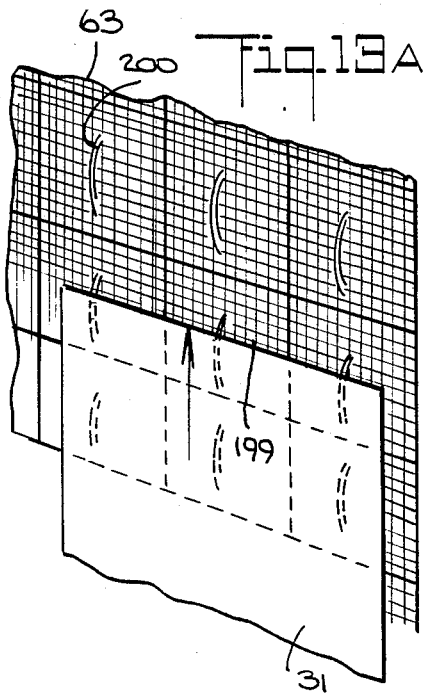

In FIG. 13A, the elastomeric version of vacuum conveyor belt 63 with vacuum apertures 131 is replaced with a structure comprised of cell grid screen 199 over each individual strip cell, with a trigger strip 200 in the center of strip cell 170. Trigger strip 200 protrudes outward slightly over the surface represented by the plane of the outermost edges between individual strip cells 170 of conveyor belt base 167. Cell grid screen 199 is just slightly below the edges of belt base 167, so that when pressure is applied to trigger strip 200, it can rest atop cell grid screen 199, essentially flush with the surface plane of belt base 167.

Trigger strip 200 is fabricated of moderate thickness material, as to have a good flexibility characteristic and an inherent spring character. In FIG. 13B, the top cross-section of the two individual strip cells 170 shows the at-rest curvature of trigger strip 200. The bottom end of trigger strip 200 hooks around valve seat ledge 208, passes out through and then re-enters by spaces in cell grid screen 199 where a backward curve which will act as a trigger strip seal lip 202 is placed. The flat portion of trigger strip 200 past the trigger strip sear lip 202 slidably rests on the top valve seat ledge, with a half-loop of trigger strip 200 then acting as a trigger strip self-spring acting against the wall of belt self-strip 168 so as to keep trigger strip sear lip 202 normally downwards. A valve flap 203 is connected to bottom valve seat ledge 208 by a valve flap pivot 210. A valve flap trigger arm 204 extends upward and to the left from about the midpoint of valve flap 203, with the right side of the tip of valve flap trigger arm 204 resting on the lower edge of trigger strip sear lip 202. In this position, the top left side of valve flap 203 is held lightly against the right side of valve ledge 208. If low pressure vacuum is supplied through connecting cell base aperture 171 and cell strip aperture 169, the vertical position of valve flap 203 essentially closes off vacuum supply to the area of cell grid screen 199.

In the bottom portion of FIG. 13B, sheet paper 31 rests atop individual strip cell 170. Sheet paper 31 mechanically depresses trigger strip 200, and may also displace trigger strip 200 upwardly. Either motion, inward or upward or both in combination will cause trigger strip sear lip 202 to displace upwardly against the very light spring action downward of trigger strip self-spring 201. The displacement upward of trigger strip sear lip 202 is a rolling action upward, using the flat portion of trigger strip 200 above trigger strip sear lip 202, resting on the upper surface of valve seat ledge 208 as a platform fulcrum. The rolling-up displacement of trigger strip sear lip 202 releases valve flap trigger 204 from its captured position, and it pivots downward under the mild force of the low pressure vacuum, until it is stopped by contact with reset toggle bar 207. A small embedded valve flap magnet 216 and a pair of reset toggle bar tip magnets 217 retain valve flap 203 lightly in an open position. Magnet 216 may be a ferrite additive contained in cast plastic and magnetized subsequently, during production. This open position of valve flap 203 now allows low pressure vacuum to communicate with the region of cell grid screen 199, thereby gripping printable materials such as sheet paper 31 or envelopes 39. When the mechanical pressure sensing of paper presence using trigger strip 200 on individual strip cells 170 is used, there is no longer a need to utilize lateral metering as described above with respect to FIG. 5. Neither is there a need to segment lower vacuum hub 61 or the vacuum conveyor interior. With the independent action of each individual strip cell 170 low pressure vacuum is only supplied to conveyor vacuum inlet 59, whereafter it is appropriately metered by the vacuum triggering action of trigger strips 200, as described above, in response to the presence of material for printing thereover.

Figure 13C:
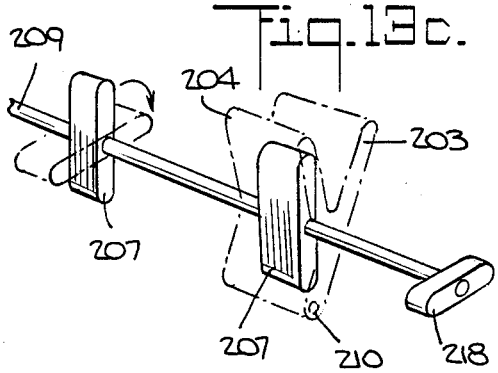

Resetting of valve flap 203 to the closed position is accomplished by rotating a reset toggle bar 207 which urges valve flap 203 upwards until valve flap trigger arm 204 again rests atop trigger strip sear lip 202. In this manner, valve flap 203 is once again retained against valve seat ledge 208, thereby closing off low pressure vacuum supply to the area of cell grid screen 199. The row of individual strip cells 170 which comprise belt cell strip 168 all have individual reset toggle bars 207 for each individual strip cell 170 mounted on a common reset toggle bar shaft, as shown in FIG. 13C. On the end of the common reset toggle bar shaft 209 which protrudes laterally through the side frame mounted control operator sealed track 188, is mounted a toggle bar shaft operator 218. In the same manner as in FIG. 11, fixed mount control cross interposer is mounted, so that when cross interposer cam bar 185 is placed in a radial position, all toggle bar shaft operators 218 passing by are moved 90 degrees as a result of vacuum conveyor 21 reverse motion, front side downwards. This 90 degree motion of toggle bar shaft operator 218 is transmitted down reset toggle bar shaft 209 to the reset toggle bars 207 behind each individual strip cell 170, resetting each valve flap trigger arm 204, and shutting off all low pressure vacuum flow in that row of individual strip cells 170.

Figure 13D:
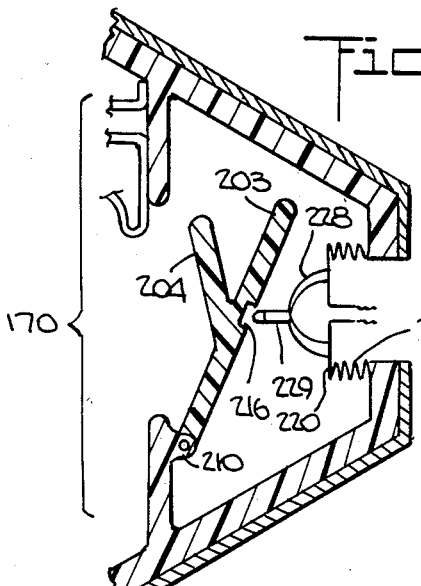

A master reset function can be provided in accordance with FIG. 13D, wherein a reset bellows 219 is added atop the cell strip aperture 169. A reset bellows plate 220 is placed at the top of reset bellows 219, and at the center of reset bellows plate 220 is a bellows plate bladder valve 227. A bellows tip magnet 229 is placed atop the reset bellows plate 220, held in place by a set of tip support wires 228.

When mechanical pressure on trigger strip 200 causes low pressure vacuum to flow through individual strip cell 170, the reset bellows 219 remains in a compacted, downward position. Low pressure vacuum flows freely around tip support wires 228 and is only very slightly impeded during passage through the inside of very flexible bellows plate bladder valve 227. However, all open valve flaps 203 are reset to a closed state by supplying low positive pressure air as a substitute for the low pressure vacuum in platen vacuum inlet 59. The positive pressure air will not flow readily through the flexible walls of bellows plate bladder valve 227, because it is applied to the exterior, which tends to close the bellows plate bladder valve 227. This restriction to flow of positive pressure air forces reset bellows 219 to expand upwards, carrying reset bellows plate 220 upwards also. This lifts the bellows tip magnet 229 which has been supplying mild hold-open force to valve flap magnet 216. Bellows tip magnet 229, as it rises, carries with it valve flap 203. This outwardly expanding motion of bellows tip magnet 229 pushes valve flap trigger arm 204 past trigger strip sear lip 202, locking valve flap 203 in the closed position.

Figure 14:
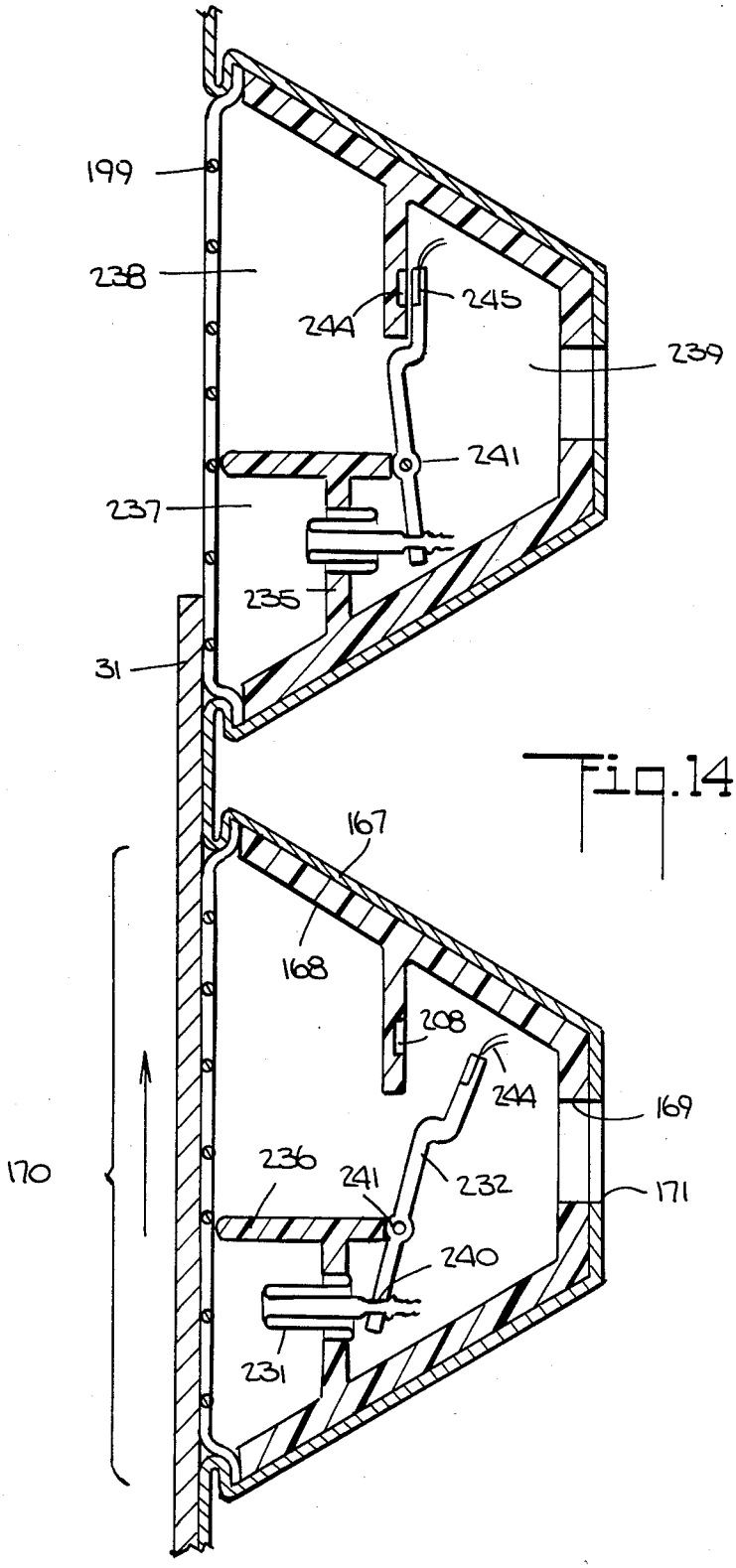
FIG. 14 is a cross-sectional representation of a portion of a flexible conveyor showing one embodiment of a pneumatically triggered valve arrangement.

Low pressure vacuum control for an individual strip cell 170 can also be obtained by providing a flow sensitive bladder 231, as shown in FIG. 14. The flow sensitive bladder 231 is mounted on a bladder compartment ledge 235. Bladder compartment ledge 235 is connected to a horizontal bladder compartment wall 236 which extends to just touch cell grid screen 199. Thus, the side wall of belt cell strip 167, bladder compartment ledge 235, and bladder compartment wall 236 form a separate region, bladder compartment 237, which is bounded on the side by strip cell grid 199. Individual strip cell 170 is thus divided into three compartments, bladder compartment 237, an upper compartment 238 on the left which is bounded by a flow controlled toggle valve 232 and valve seat ledge 208 on the right, and a right compartment 239 which communicates with low pressure vacuum supply in the interior of vacuum conveyor 21 by means of cell strip aperture 169 and cell base aperture 171.

Flow controlled toggle valve 232 is mounted to the right end of bladder compartment wall 236 by a flow valve pivot 241. When flow controlled toggle valve 232 is in an upward position against valve seat ledge 208, low pressure vacuum supply to upper compartment 238 and the area of cell grid screen 199 is essentially discontinued. Flow sensitive bladder 231 is formed of an elastic material, preferably an elastomeric, to derive the properties of memory of as-formed shape. Flow sensitive bladder 231 is fastened to flow controlled toggle valve 232 by a bladder neck connector 240, below which the flow sensitive bladder 231 has highly flexible walls so as to prevent upwards air flow, yet forming little or no restriction to downwards flow.

In FIG. 14, individual strip cell 170 at the top does not have printable material, such as sheet paper 31 or envelopes 39 atop cell grid screen 199. Since low pressure vacuum is present in compartment 239, air will flow from the cell grid 199 area and bladder compartment 237, through flow sensitive bladder 231 into compartment 239. This flow of air through flow sensitive bladder 231 distends the flow sensitive bladder to the right, and through bladder neck connector 240, forces the other end of flow controlled toggle valve to the left. A weak valve seat ledge magnet 244 and a weak toggle valve magnet 245 are just sufficient to hold flow controlled toggle valve 232 shut against variant forces such as machine vibration. The as-formed memory forces inherent in flow sensitive bladder 231 are such that the force of the flow of air through flow sensitive bladder plus the weak magnetic attraction of valve seat ledge magnet 244 and toggle valve magnet 245 are just high enough to counteract the tendency of flow sensitive bladder 231 to restore itself to the leftward, as-formed, shape. When flat, printable materials, such as sheet paper 31, are placed on cell grid screen 199 above the bladder compartment, the flow of air through flow sensitive bladder 231 is sharply reduced. The leftward memory forces now overbalance the other forces, and pull the bottom end of flow controlled toggle valve 232 to the left. This opening of flow controlled toggle valve 232 bypasses vacuum air flow through the flow sensitive bladder 231 to a larger flow through the opening now available between the compartment 239 and the compartment 238, as in the individual cell strip shown at the left of FIG. 14.

Vacuum gripping of sheet paper 31 or other flat printable materials will now occur at cell grid screen 199 above compartment 238. Very little vacuum flow will occur through the higher resistance to flow of flow sensitive bladder 231.

Master resetting to close all flow controlled toggle valves 232 can be done by substituting a burst of low pressure positive pressure air into the interior of vacuum conveyor 21 for the normal low pressure vacuum. Admitting low pressure positive pressure air will reverse the direction of flow within individual strip cell 170. While rightward flow caused by application of low pressure vacuum to the interior of vacuum conveyor 21 will easily deform a flexible toggle valve tip flap 246 to represent a negligible flow impedance, the application of positive pressure to the interior of vacuum conveyor 21 will cause flexible toggle valve tip flap 246 to distort from its rest position, and tend to block the air flow. This blockage will present an unbalanced leftward force on the top of flow controlled toggle valve 232, since reverse air flow through flow sensitive bladder 231 cannot occur. This leftward force then closes flow controlled toggle valve 232 by rotating it leftward around flow valve pivot 241 to its closure position against the side of valve seat ledge 208. Again, after positive pressure air is removed and the supply of low pressure vacuum is resumed, weak valve seat ledge magnet 244 and weak toggle valve magnet 245 will hold flow controlled toggle valve 232 in its closed position, if no flat, printable material is present atop cell grid screen 199, so that vacuum-sponsored air flow through flow-sensitive bladder is adding a rightward force assisting closure of controlled toggle valve 232.

Mechanical reset of the controlled toggle valves 232 in a row of individual strip cells can be accomplished by adding mechanical reset toggle bar 207 on reset toggle bar shaft 209, as shown in FIG. 13C. Similarly, an external control, such as control cross interposer 184 of FIG. 12E can be used to synchronize the mechanical reset function.

FIGS. 15A and 15B show another embodiment of a pressure-reference trigger. As shown in FIG. 15A, the bottom wall of belt cell strip 168, a separator wall 255, and a bottom portion of a separator wall 264 comprise an outer compartment 257. A formed elastic membrane 256 is installed in separation wall 255. The reverse side of formed elastic membrane 256 has a reference piston 260 attached thereto. In turn, reference piston 260 is connected to a sliding plug valve 262 by a piston shaft 261. Sliding plug valve 262 is sealed annularly by, and travels longitudinally within, a rolling plug seal membrane 252. Downward travel of sliding plug valve 262 is limited by a set of reference chamber stops 253. Upward travel of sliding plug valve 262 is limited by contact with a plug valve seat 263. Sliding plug valve 262, however, does not completely stop air flow, because several plug valve seat grooves 267 are provided in the outer face of plug valve seat 263, so as to bleed a controlled amount of air when sliding plug valve 262 is upwardmost.

Reference chamber 254 can be sealed during manufacture to provide an atmospheric standard. In a preferred embodiment, this reference chamber is provided with a filamentary tube 251 which extends from the interior of reference chamber 254 to be level with the outer surface of cell grid screen 199, so as to communicate with exterior air pressure and provide a long term average value within the reference chamber 254. When flat, printable material such as sheet paper 31 lies atop individual strip cell 170, the inner side of sheet paper 31 closes off the outer end of filamentary tube 251.

When low pressure vacuum is supplied to the interior of vacuum conveyor 21, the vacuum communicates with each individual strip cell 170 through cell base aperture 171 and cell strip aperture 169, thus supplying low pressure vacuum to compartment 239. Vacuum-induced air flow cannot pass through a reset bleeder valve 266 because the flexible walls of reset bleeder valve 266 will collapse together. Air does flow, however, through plug valve seat grooves 267 from a baffle chamber 268. At the very low flow rates permitted by plug valve seat grooves 267, the bulk of the flow will occur at cell grid screen 199 near a flow gap 269 formed between a separator ledge 250 and separator wall 255. Even though separator wall 255 extends somewhat below cell grid screen 199, since compartment 257 is open to atmospheric pressure through cell grid screen 199, the resulting pressure in compartment 257 is unaffected by the nearby vacuum flow, and remains at atmospheric pressure. Since the compartment 257 and the reference chamber 254 are both at atmospheric pressure, there is no net force on elastic membrane 256 and sliding plug valve 262 will stay against plug valve seat 263.

When flat, printable material such as sheet paper 31 covers a large portion of individual strip cell 170, the vacuum flow previously described as occurring mostly in air flow gap 269 grips the paper weakly and the air flow is diverted to any remaining openings in cell grid screen 199.

Some air flow occurs to the left of separator wall 255, lowering the pressure in compartment 257. This unbalances the air pressures across formed elastic membrane 256. The slightly lower pressure in compartment 257, compared to the atmospheric pressure in the reference chamber, creates a net force downward on formed elastic membrane 256, thereby moving reference piston 260 downward. This opens an even larger gap between sliding plug valve 262 and plug valve seat 263. The air flow is markedly increased, and both the gripping force on sheet paper 31 and the level of vacuum pressure in outer compartment 257 rise. With a larger value of vacuum in outer compartment 257, the formed elastic membrane 256 and the reference piston 260 both move downward. This cycle of events increases until sliding plug valve 262 is completely downward against reference chamber stops 253. With sliding plug valve 262 completely open, gripping forces on sheet paper 31 are at a maximum, and with sheet paper 31 atop individual strip cell 170, the reduced flow of air will ensure that the outer compartment is at a low vacuum level, also ensuring that sliding plug valve 262 remains downward, as in the bottommost individual strip cell 170 shown in FIG. 15.

To reset all open sliding plug valves 262, a burst of low pressure positive air can replace the low pressure vacuum. Positive pressure air will readily flow through reset bleeder valve 266 and sharply replace the negative pressure present in outer compartment 257 with positive pressure, rapidly closing sliding plug valve 252. However, sliding plug valve 252 will have been open long enough to pass a burst of positive pressure so as to sharply dislodge any flat, printable material, such as sheet paper 31 atop individual strip cell 170. Alternately, if sheet paper 31 is not to be discharged but is withdrawn for a second printing pass, the removal of sheet paper 31 will cause the outer chamber to have the previous negative pressure replaced by atmospheric pressure. The forces on the reference piston 260 and sliding plug valve 262 are now removed, except for the molded shape of formed elastic shape 256, which exerts a mild upward force, sufficient to move sliding plug valve 262 slowly upward, or closed.

It is also possible to provide for row by row mechanical reset of sliding plug valve 262 to the closed state. FIG. 15B shows a sliding plug reset arm 272 which has been added to sliding plug valve 262. Reset toggle bar 207 is mounted below the lower end of sliding plug reset arm 272 so that when reset toggle bar 207 is rotated clockwise, sliding plug reset arm 272 and sliding plug valve 262 are mechanically pushed to upward, or closed position. The reset toggle bars, for a row of individual strip cells 107, are mounted on common toggle bar shaft 182. The toggle bar shafts 182 for each row extends through control operator sealed track 188 in platen side frame 154, and operated selectively by interposer mechanisms as shown in FIG. 11 and FIG. 12.

Although the invention has been described in terms of specific embodiments and applications, persons skilled in the art, in light of this teaching, can generate additional embodiment without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A paper transport arrangement for a printer, the paper transport arrangement being of the type wherein a sheet of paper is received from a supply and transported across a predetermined print zone where printing may occur, the paper transport arrangement comprising:

vacuum roller means for grasping the sheet of paper and transporting the sheet of paper across the predetermined print zone, said vacuum roller means having an axis of rotation and a plurality of apertures on a surface thereof, said vacuum roller means adapted to be coupled to a supply of reduced air pressure thereby to provide a reduced air pressure at said apertures which attracts and holds the sheet of paper;

flexible vacuum conveyor means arranged to transport the paper in a direction which is essentially orthogonal to said axis of rotation of said vacuum roller means, said flexible vacuum conveyor means adapted to be coupled to the supply of reduced air pressure and having a plurality of apertures on a surface thereof thereby to provide a reduced air pressure at said apertures which attracts the sheet of paper, said vacuum conveyor means being arranged on the other side of the predetermined print zone from said vacuum roller means;

printing support means for supporting the sheet of paper during printing arranged in said predetermined print zone; and vacuum chamber means arranged in the vicinity of said predetermined print zone and intermediate of said vacuum roller means and said flexible vacuum conveyor means, said vacuum chamber means adapted to be coupled to the supply of reduced air pressure and having a plurality of apertures on a surface thereof thereby to provide a reduced air pressure at said apertures which holds the sheet of paper in the vicinity of said predetermined print zone;

said flexible vacuum conveyor means further comprising a plurality of flexible cells arranged in a predetermined array configuration, said flexible cells being adapted to receive said reduced air pressure, each of said flexible cells being at least partially isolated pneumatically from others of said flexible cells, said flexible vacuum conveyor means comprising a base means having a closed loop configuration so as to form a belt, and further being adapted to hold said flexible cells in said predetermined array configuration, said flexible cells on said flexible conveyor base means being provided with respectively associated valve means for adjusting a pneumatic impedance through which said reduced air pressure is conducted to said apertures on said surface of said flexible vacuum conveyor means in response to the presence of the sheet of paper adjacent to said valve means, the presence of a sheet of paper reducing said pneumatic impedance to permit increased communication between said apertures and said reduced air pressure;

said vacuum chamber means being in vacuum communication with said vacuum roller means, and there further being provided first seal means on said vacuum chamber means for forming a seal which substantially prevents air leakage at said surface of said vacuum roller means.

2. The paper transport arrangement of claim 1 wherein said vacuum chamber means is further provided with second seal means for forming a seal against said surface of said flexible vacuum conveyor means.

3. The paper transport arrangement of claim 1 wherein said vacuum roller means further comprises:

shaft means for supporting said vacuum roller means in a predetermined orientation with respect to the supply of the paper to be printed and being arranged coaxially with said axis of rotation of said vacuum roller means; and first and second roller portions arranged coaxially on said shaft means, each of said first and second roller portions having said apertures on surfaces thereof.

4. The paper transport arrangement of claim 3 wherein said shaft means has a hollow, tubular configuration and is fixed so as to be nonrotatable with respect to the predetermined print zone and said first and second roller portions are adapted to be rotatable about said shaft means, there being further provided vacuum supply means connected to said shaft means so as to produce a reduced air pressure within said hollow, tubular configuration of said shaft means, said shaft means being further provided with at least one aperture so as to allow said first and second roller portions to communicate with said vacuum supply means.

5. The paper transport arrangement of claim 4 wherein there is further provided vacuum location means arranged within said shaft means for controlling said reduced air pressure within a predetermined low pressure zone within said shaft means, an axial dimension of said predetermined low pressure zone being responsive to a dimension of the sheet of paper.

6. The paper transport arrangement of claim 3 wherein said first and second roller portions are each comprised of a plurality of substantially cylindrical segments which are axially arranged and bonded to one another, each of said cylindrical segments being formed of a plastic material and adapted to produce a pneumatically isolatable roller vacuum chamber.

7. The paper transport arrangement of claim 1 wherein there is further provided paper sensor means for detecting the location of the sheet of paper, said paper sensor means being arranged in the vicinity of said vacuum roller means.

8. The paper transport arrangement of claim 7 wherein there is further provided paper orientation drive means connected to said first and second roller portions for rotating said first and second roller portions with respect to one another in response to said paper sensor means to align the paper to be printed in a predetermined orientation.

9. The paper transport arrangement of claim 1 wherein said valve means is provided with mechanical trigger means for causing said valve means to change from a high pneumatic impedance state to a low pneumatic impedance state in response to mechanical contact between said mechanical trigger means and the sheet of paper.

10. The paper transport arrangement of claim 1 wherein said valve means is provided with flow sensitive trigger means for causing said valve means to change from a high pneumatic impedance state to a low pneumatic impedance state in response to a reduction in the quantity of air flowing through said apertures on said surface of said flexible vacuum conveyor means when the sheet of paper is arranged to cover at least a portion of one of said apertures.

11. The paper transport arrangement of claim 1 wherein there is further provided pressure sensitive trigger means for causing said valve means to change from a high pneumatic impedance state to a low pneumatic impedance state in response to a reduction in air pressure in a sensing chamber of said flexible cells, said reduction in air pressure being produced in response to the sheet of paper being arranged to cover at least partially at least one of said apertures on said surface of said flexible vacuum conveyor means.

12. In a printer, a paper feed and transport system for positioning paper for printing, the paper feed and transport system comprising:

strike bar means for providing a backing against which impact printing is performed and having a longitudinal axis;

roller means for transporting said paper from a paper supply location across said strike bar means, said paper being moved in a direction which is transverse to said longitudinal axis of said strike bar means;

flexible conveyor means for transporting said paper beyond said strike bar means, said flexible conveyor means being arranged in the vicinity of said strike bar means;

said roller means comprising a vacuum roller having a plurality of apertures distributed thereover, said vacuum roller further having sectoring means therein for applying a suction force corresponding to a low air pressure through said apertures only over a selectable axial segment of said vacuum roller;

said flexible conveyor means being arranged as a continuous loop having a plurality of selective valve means disposed thereon whereby a suction force of a predetermined magnitude is provided only through ones of said selective valve means which are covered by the paper, remaining ones of said selective valve means each providing a suction force having a lower magnitude than said predetermined magnitude, said valve means being provided in a predetermined array configuration on said continuous loop;

there being further provided tilt means for said flexible conveyor means for tilting said flexible conveyor means in a preselected direction and for depositing said paper at a preselected stacking location, said tilt means comprising first and second pivot couplings displaced from one another by a predetermined distance, said flexible conveyor means being pivotally movable about said first and second pivot couplings, and pivot coupling lock means for locking one of said first and second pivot couplings to limit pivotal motion thereabout by said flexible conveyor means.

13. The paper feed and transport system of claim 12 wherein there is further provided:

at least two bins for holding respective stacks of paper which are desired to be printed upon; and selector means for selecting one of said bins and for providing paper from said respective stack of paper to said paper supply location.

14. The paper feed and transport system of claim 12 wherein there is further provided paper supply means for providing an essentially continuous supply of the paper.

15. The paper feed and transport system of claim 12 wherein there is further provided a paper alignment arrangement for positioning the paper on said roller means so as to be transported across said strike bar in a predetermined orientation.

16. The paper feed and transport system of claim 12 wherein said flexible conveyor means is adapted to receive an expulsive force which is produced by conducting pressurized air through selected ones of said selective valve means when it is desired to remove the paper from said flexible conveyor means.

17. The paper feed and transport system of claim 12 wherein said selective valve means which are covered by said paper each provide a respective communication path through said flexible conveyor means having a lower impedance to air flow than a respective communcation path provided by each of said remaining ones of said selective valve means.

18. The paper feed and transport system of claim 12 wherein each of said selective valve means is provided with an associated cell having an opening for communicating with a region of reduced air pressure.

19. The paper feed and transport system of claim 12 wherein there is further provided valve reset means for resetting said selective valve means to provide said suction force having a lower magnitude than said predetermined magnitude after the paper has been removed from thereover.

20. The paper feed and transport system of claim 19 wherein there is further provided:

toggle bar means arranged in the vicinity of said selective valve means for urging said valve reset means to a reset position; and reset shaft means connected to said toggle bar means for moving said toggle bar means and thereby urging said valve reset means to said reset position.

21. The paper feed and transport system of claim 19 wherein there is further provided air pressure responsive valve means for resetting said selective valve means in response to a positive air pressure.

22. A flexible conveyor for transporting sheet material, the flexible conveyor having a belt-like base member which is arranged to be movable about first and second rotatable rollers, the flexible conveyor further being of the type which utilizes a suction force to hold the sheet material to an outer surface of the flexible conveyor, the flexible conveyor further comprising vacuum control means for controlling the application of the suction force to the surface of the flexible conveyor, the suction force being controlled to have a first magnitude over a first portion of the surface of the flexible conveyor, and a second magnitude over a second portion of the surface of the flexible conveyor, said second portion being substantially coextensive with the sheet material, said flexible conveyor being provided with a plurality of apertures on the outer surface thereof through which the suction force is applied to the sheet material, said vacuum control means further comprising a plurality of cell means disposed in a predetermined array in said flexible conveyor, each associated with at least one of said apertures on the outer surface of the flexible conveyor, and valve means disposed in said flexible conveyor for controlling the suction force applied to said apertures associated with respective ones of said cell means in response to whether the sheet material is arranged over at least a portion of said cell means, the cell means being arranged to form a plurality of columns of said cell means, said columns of said cell means being substantially parallel with respect to each other and to a direction of motion of the belt-like base member, there being further provided a plurality of divider means for producing a plurality of vacuum plenums which are pneumatically substantially isolated from each other extending in the direction of motion of the belt-like base member, said divider means being arranged so that respective ends thereof sealably contact the first and second rotatable rollers and are separated from one another by a distance which accommodates a column of said cell means, said column of said cell means being movable in the direction of motion of the belt-like base member with respect to said divider means.

23. The flexible conveyor of claim 22 wherein said valve means is provided with mechanical trigger means for causing said valve means to change from a high pneumatic impedance state to a low pneumatic impedance state in response to mechanical contact between said mechanical trigger means and the sheet material.

24. The flexible conveyor of claim 22 wherein said valve means is provided with flow sensitive trigger means for causing said valve means to change from a high pneumatic impedance state to a low pneumatic impedance state in response to a reduction in the quantity of air flowing through said apertures on said surface of said flexible conveyor when the sheet material is arranged to cover at least a portion of one of said apertures.

25. The flexible conveyor of claim 22 wherein said valve means is provided with pressure sensitive trigger means for causing said valve means to change from a high pneumatic impedance state to a low pneumatic impedance state in response to a reduction in air pressure in a sensing chamber of said cell means, said reduction in air pressure being produced in response to the sheet material being arranged to cover at least partially at least one of said apertures on said surface of the flexible conveyor.

26. The flexible conveyor of claim 22 wherein said first rotatable roller is provided with a plurality of roller apertures thereover to provide a low pneumatic pressure to respectively associated ones of said vacuum plenums.

27. The flexible conveyor of claim 26 wherein said first rotatable roller is further provided with means for selecting a group of said plurality of roller apertures which will be provided with said low pneumatic pressure, said ones of said vacuum plenums which are associated with said selected group of said plurality of roller apertures defining said first predetermined portion of the surface of the flexible conveyor.

28. The flexible conveyor of claim 27 wherein said first rotatable roller is provided with a hollow tubular shaft, said means for selecting comprising first and second sources of said low pneumatic pressure slidably engaged within said hollow tubular shaft, said selected group of said plurality of roller apertures being disposed intermediate of said first and second sources of said low pneumatic pressure.

29. The flexible conveyor of claim 26 wherein there is further provided a sheet material depository for receiving the sheet material from the flexible conveyor, after it has been tilted.

30. The flexible conveyor of claim 22 wherein there is further provided means for supplying a pneumatic pressure greater than that of the suction force to a selected portion of said flexible conveyor for removing the sheet material.

31. The flexible conveyor of claim 22 wherein there is further provided means for rotating one of said first and second rotatable rollers about the other to tilt the flexible conveyor.

32. A paper handling apparatus for a printer comprising:

a vacuum conveyor having at least a flexible belt portion with a plurality of apertures in an exterior surface thereof;

a vacuum source connected with the interior of said vacuum conveyor to draw a vacuum through said apertures whereby a paper to be printed is firmly held on said exterior surface of said vacuum conveyor;

vacuum feed roller means for engaging said paper to be printed and for moving said paper to a print zone;

vacuum print bar means for holding said paper securely in the vicinity of said print zone disposed between said vacuum feed roller means and said vacuum conveyor;

a plurality of sensing means disposed in said vacuum conveyor for sensing the presence of said paper in the vicinity of a predetermined portion of the exterior surface of said vacuum conveyor; and a plurality of pilot valve means responsive to said sensing means for controlling the vacuum drawn through the apertures in said predetermined portion of said exterior surface of said vacuum conveyor, said valve means being disposed in said flexible belt portion of said vacuum conveyor, said vacuum print bar means being disposed in a vacuum chamber, said vacuum chamber being in vacuum communication with said vacuum feed roller means, and there further being provided first seal means on said vacuum chamber for forming a seal which substantially prevents air leakage at the surface of said vacuum feed roller means.

33. A paper handling apparatus according to claim 32 further comprising:

supply bin means for holding said paper to be printed; and means for transporting said paper to be printed from said supply bin means to said vacuum feed roller means.

34. A paper handling apparatus according to claim 32 wherein said sensing means comprises a trigger mechanism for opening a selected group of said pilot valve means to communicate an enlarged suction force of said vacuum source to said apertures in said predetermined portion of said exterior surface of said vacuum conveyor.

35. A paper handling apparatus according to claim 34 wherein said trigger mechanism is responsive to pressure and adapted to open said pilot valve means associated with said apertures in said predetermined portion of said vacuum conveyor near which said paper is disposed, whereby said vacuum source exerts said enlarged suction force of the vacuum only at a portion of said vacuum conveyor essentially covered by said paper.

36. A paper handling apparatus according to claim 34 wherein said trigger mechanism is responsive to pneumatic flow rate and adapted to open said pilot valve means associated with said apertures through which flow is restricted when covered by said paper, whereby said vacuum source exerts said enlarged suction force of the vacuum only at said portion of said conveyor essentially covered by said paper.

37. A paper handling apparatus according to claim 32 further comprising means for supplying a positive pressure to said vacuum conveyor to release said paper held thereto.

38. A paper handling apparatus in accordance with claim 37, wherein said vacuum conveyor is rotatably mounted to be rotatable in a selected direction before releasing said paper.

39. A paper handling apparatus in accordance with claim 32, further comprising means for dividing said vacuum conveyor into longitudinal segments arranged substantially parallel to said direction of travel of said paper, whereby said vacuum source applies a vacuum force to a selected number of segments corresponding in width to the width of said paper to be printed.

40. A paper handling apparatus according to claim 32, wherein said vacuum feed roller means is divided into a plurality of axial segments, and further comprising means for limiting said plurality of axial segments of said vacuum feed roller means subjected to said vacuum source to a selected number of said axial segments corresponding in width to the width of said paper to be printed.

* * * * *